US011735347B2

(12) United States Patent
Shiga et al.

(10) Patent No.: US 11,735,347 B2
(45) Date of Patent: Aug. 22, 2023

(54) MULTILAYER COIL COMPONENT

(71) Applicant: TDK CORPORATION, Tokyo (JP)

(72) Inventors: Yuto Shiga, Tokyo (JP); Hajime Kato, Tokyo (JP); Kazuya Tobita, Tokyo (JP); Youichi Kazuta, Tokyo (JP); Noriaki Hamachi, Tokyo (JP); Makoto Yoshino, Tokyo (JP)

(73) Assignee: TDK CORPORATION, Tokyo (JP)

( * ) Notice: Subject to any disclaimer, the term of this patent is extended or adjusted under 35 U.S.C. 154(b) by 436 days.

(21) Appl. No.: 16/901,165

(22) Filed: Jun. 15, 2020

(65) Prior Publication Data

US 2020/0402701 A1 Dec. 24, 2020

(30) Foreign Application Priority Data

Jun. 21, 2019 (JP) ..... 2019-115626

(51) Int. Cl.

| | |
|---|---|
| ***H01F 5/00*** | (2006.01) |
| ***H01F 17/00*** | (2006.01) |
| ***H01F 27/29*** | (2006.01) |
| ***H01F 41/04*** | (2006.01) |
| ***H01F 27/32*** | (2006.01) |

(52) U.S. Cl.

CPC ..... *H01F 17/0013* (2013.01); *H01F 27/29* (2013.01); *H01F 27/323* (2013.01); *H01F 41/043* (2013.01)

(58) Field of Classification Search

CPC ..... H01F 27/29
USPC ..... 336/200
See application file for complete search history.

(56) References Cited

U.S. PATENT DOCUMENTS

2007/0188288 A1* 8/2007 Ishii ..... H01F 17/0013 336/200
2011/0001599 A1* 1/2011 Takenaka ..... H01F 17/0013 336/200
2014/0247102 A1* 9/2014 Kurobe ..... H01F 41/041 336/200
2015/0137929 A1* 5/2015 Park ..... H01F 17/0013 336/200
2016/0042860 A1* 2/2016 Choi ..... H01F 17/0013 336/200
2016/0141102 A1* 5/2016 Tseng ..... H01F 27/292 336/200
2016/0372261 A1* 12/2016 Ozawa ..... H01F 17/0013
2017/0004918 A1* 1/2017 Kido ..... H01F 27/292

(Continued)

FOREIGN PATENT DOCUMENTS

JP 2017-073536 A 4/2017

*Primary Examiner* — Ronald Hinson
(74) *Attorney, Agent, or Firm* — Oliff PLC

(57) ABSTRACT

A pair of terminal electrodes 4 and 5 have electrode parts 4*a* and 5*a* and electrode parts 4*b* and 5*b* when viewed from a stacking direction, respectively. A plurality of connection conductors are disposed at positions not overlapping a plurality of coil conductors when viewed from the stacking direction. At least two of the plurality of connection conductors are disposed in a first region A1 or a second region A2 between the terminal electrodes 4 and 5 and an outer edge 9*a* of a coil 9 when viewed from the stacking direction. The first region A1 and the second region A2 overlap the electrode parts 4*a* and 5*a* when viewed from the facing direction of a pair of end surfaces 2*a* and 2*b* and overlap the electrode parts 4*b* and 5*b* when viewed from the facing direction of a pair of main surfaces 2*c* and 2*d*.

6 Claims, 7 Drawing Sheets

(56) References Cited

U.S. PATENT DOCUMENTS

| | | | | |
|---|---|---|---|---|
| 2017/0103848 | A1* | 4/2017 | Yoneda | H01F 17/0013 |
| 2019/0051450 | A1* | 2/2019 | Shimoda | H01F 27/323 |
| 2019/0318867 | A1* | 10/2019 | Lee | H01F 5/06 |
| 2019/0333689 | A1* | 10/2019 | Park | H01F 27/32 |
| 2019/0355508 | A1* | 11/2019 | Lim | H01F 17/0013 |

* cited by examiner

MULTILAYER COIL COMPONENT

TECHNICAL FIELD

The present invention relates to a multilayer coil component.

BACKGROUND

The multilayer coil component that is described in Patent Literature 1 (Japanese Unexamined Patent Publication No. 2017-73536) is known as an example of multilayer coil components of the related art. The multilayer coil component described in Patent Literature 1 includes an element body, a coil disposed in the element body, and a pair of terminal electrodes embedded in the element body and disposed over the end and mounting surfaces of the element body.

SUMMARY

The mounting space of an electronic component allowed in an electronic device tends to shrink with the size of the electronic device. Accordingly, size reduction (lower profile) is also required for the multilayer coil component. It is necessary to increase the number of coil windings in order to obtain predetermined characteristics while realizing size reduction in the multilayer coil component. In the multilayer coil component, the coil is configured to include a plurality of coil conductors and a connection conductor connecting a pair of the coil conductors that are adjacent to each other. In this multilayer coil component, an increase in the number of coil windings during size reduction inevitably results in a decrease in inter-conductor distance in the direction in which the conductors are stacked. The coil conductor and the connection conductor are stacked at the part of the multilayer coil component where the connection conductor is disposed, and thus the volume in the stacking direction increases. In a case where pressure is applied to the element body in a manufacturing process or the like in this configuration, deformation may occur at the part of stacking of the connection conductor and the coil conductor with a large volume and the deformation may lead to a short circuit between the coil conductor and the connection conductor.

An object of one aspect of the present invention is to provide a multilayer coil component that is capable of suppressing a decline in reliability while realizing size reduction.

A multilayer coil component according to one aspect of the present invention includes an element body having a plurality of stacked dielectric layers and having a pair of end surfaces facing each other, a pair of main surfaces facing each other, and a pair of side surfaces facing each other in a stacking direction of the plurality of dielectric layers, one of the main surfaces being a mounting surface, a coil disposed in the element body, including a plurality of coil conductors and a plurality of connection conductors connecting the coil conductors adjacent to each other in the stacking direction, and having a coil axis extending along the stacking direction, and a pair of terminal electrodes connected to the coil and respectively disposed in recess portions of the element body on the pair of end surface sides of the element body. Each of the recess portions of the element body is provided over the end surface and the mounting surface, each of the pair of terminal electrodes has a first part extending along a facing direction of the pair of main surfaces and a second part extending along a facing direction of the pair of end surfaces when viewed from the stacking direction, the plurality of connection conductors are disposed at positions not overlapping the plurality of coil conductors when viewed from the stacking direction, at least two of the plurality of connection conductors are disposed in a region between the terminal electrode and an outer edge of the coil when viewed from the stacking direction, and the region overlaps the first part when viewed from the facing direction of the pair of end surfaces and overlaps the second part when viewed from the facing direction of the pair of main surfaces.

In the multilayer coil component according to one aspect of the present invention, the plurality of connection conductors are disposed at positions that do not overlap the plurality of coil conductors when viewed from the stacking direction. At least two of the plurality of connection conductors are disposed in the region between the terminal electrode and the outer edge of the coil when viewed from the stacking direction. In this manner, in the multilayer coil component, the positions of the coil conductor and the connection conductor are shifted in the stacking direction. As a result, in the multilayer coil component, it is possible to avoid an increase in volume attributable to stacking of the coil conductor and the connection conductor. Accordingly, in the multilayer coil component, the occurrence of deformation can be suppressed even in a case where pressure is applied to the element body. Accordingly, in the multilayer coil component, it is possible to suppress the occurrence of a short circuit between the coil conductor and the connection conductor. In addition, in the multilayer coil component, the region where the connection conductor is disposed overlaps the first part when viewed from the facing direction of the pair of end surfaces and overlaps the second part when viewed from the facing direction of the pair of main surfaces. In this manner, in the multilayer coil component, the connection conductor is disposed in the region, and thus a deterioration in characteristics can be suppressed as compared with a case where the connection conductor is disposed inside the coil. As a result, in the multilayer coil component, it is possible to suppress a decline in reliability while realizing size reduction.

In one embodiment, the terminal electrode may be formed by a first electrode layer and a second electrode layer being stacked in the stacking direction, a width of the first electrode layer in the facing direction of the pair of end surfaces and a width of the first electrode layer in the facing direction of the pair of main surfaces may be smaller than a width of the second electrode layer in the facing direction of the pair of end surfaces and a width of the second electrode layer in the facing direction of the pair of main surfaces when viewed from the stacking direction, and the connection conductor disposed in the region may be disposed in the same layer as the first electrode layer. In this configuration, it is possible to increase the distance between the terminal electrode and the connection conductor disposed in the region. Accordingly, in the multilayer coil component, the stray capacitance (parasitic capacitance) generated between the terminal electrode and the coil can be reduced. As a result, it is possible to achieve an improvement in characteristics in the multilayer coil component.

In one embodiment, the connection conductor disposed in the region may have a part parallel to the outer edge of the coil when viewed from the stacking direction. In this configuration, it is possible to increase the distance between the terminal electrode and the connection conductor disposed in the region while ensuring the area of the connection conductor. Accordingly, in the multilayer coil component, it is possible to reliably interconnect the coil conductors and reduce the stray capacitance generated between the terminal electrode and the coil. As a result, it is possible to achieve an improvement in characteristics in the multilayer coil component.

In one embodiment, a part of the coil overlapping the terminal electrode when viewed from the facing direction of the pair of end surfaces may have a shape in which an outer shape of the outer edge in the facing direction of the pair of end surfaces becomes small from the other main surface toward the mounting surface when viewed from the stacking direction. In this configuration, it is possible to reliably ensure the region where the connection conductor is disposed between the terminal electrode and the outer edge of the coil.

In one embodiment, a first distance as a shortest distance between an outer edge of the coil and a corner portion formed by the first part and the second part may be larger than a second distance as a shortest distance between the first part and an outer edge of the coil and a third distance as a shortest distance between the second part and the outer edge of the coil when viewed from the stacking direction. In this configuration, it is possible to reliably ensure the region where the connection conductor is disposed between the terminal electrode and the outer edge of the coil.

In one embodiment, the connection conductor disposed in the region may be disposed on a straight line connecting the corner portion of the terminal electrode and the outer edge of the coil and having the first distance when viewed from the stacking direction. In this configuration, it is possible to maximize the distance between the terminal electrode and the connection conductor disposed in the region. Accordingly, in the multilayer coil component, the stray capacitance generated between the terminal electrode and the coil can be reduced. As a result, it is possible to achieve an improvement in characteristics in the multilayer coil component.

According to one aspect of the present invention, it is possible to suppress a decline in reliability while realizing size reduction.

DETAILED DESCRIPTION

Hereinafter, preferred embodiments of the present invention will be described in detail with reference to the accompanying drawings. It should be noted that the same or corresponding elements will be denoted by the same reference symbols without redundant description in the description of the drawings.

First Embodiment

Figure 1:
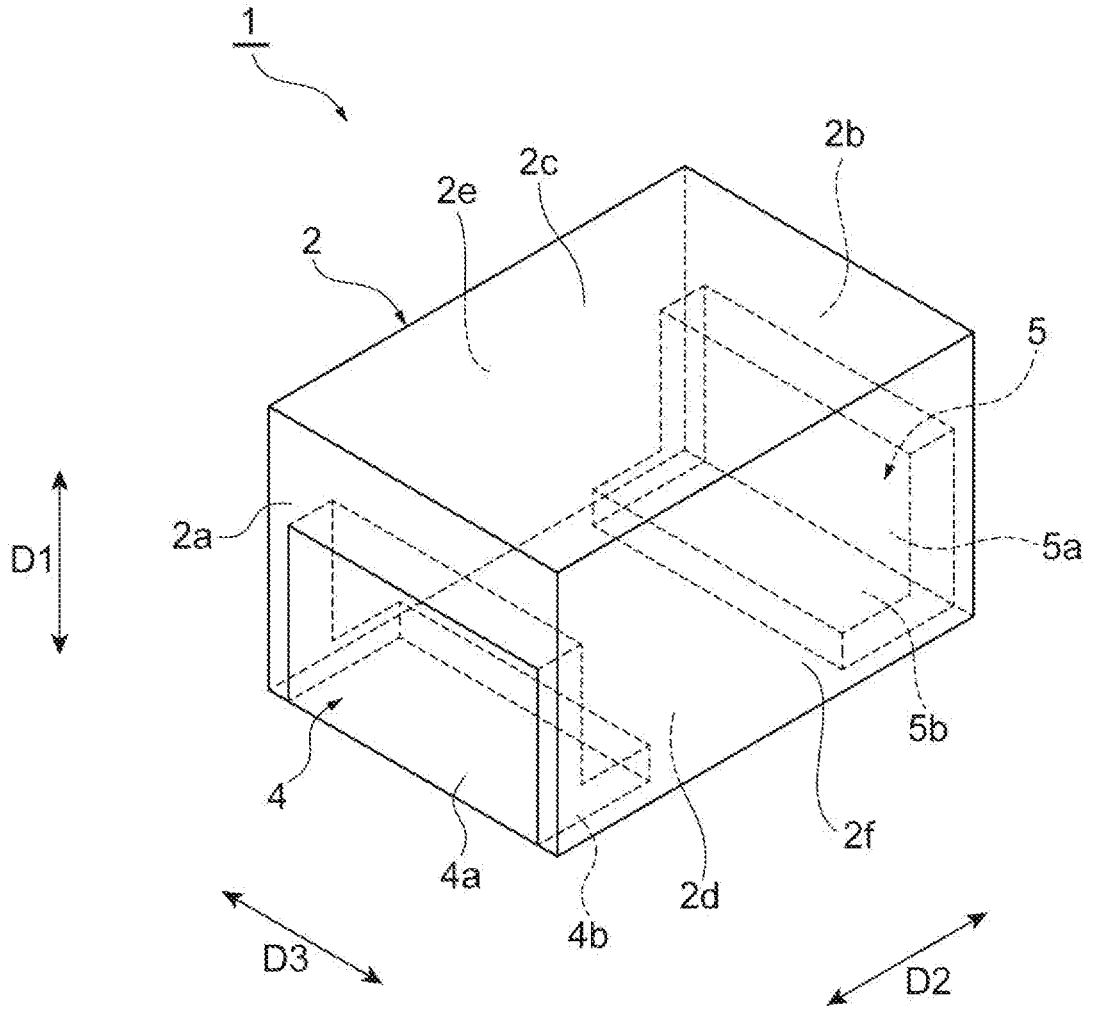
FIG. 1 is a perspective view of a multilayer coil component according to a first embodiment.

As illustrated in FIG. 1, a multilayer coil component 1 includes an element body 2 having a rectangular parallelepiped shape and a pair of terminal electrodes 4 and 5. The pair of terminal electrodes 4 and 5 are respectively disposed in both end portions of the element body 2. The rectangular parallelepiped shape includes a rectangular parallelepiped shape in which a corner portion and a ridge line portion are chamfered and a rectangular parallelepiped shape in which a corner portion and a ridge line portion are rounded.

The element body 2 has a pair of end surfaces 2*a* and 2*b* facing each other, a pair of main surfaces 2*c* and 2*d* facing each other, and a pair of side surfaces 2*e* and 2*f* facing each other. The direction in which the pair of main surfaces 2*c* and 2*d* face each other, that is, a direction parallel to the end surfaces 2*a* and 2*b* is a first direction D1. The direction in which the pair of end surfaces 2*a* and 2*b* face each other, that is, a direction parallel to the main surfaces 2*c* and 2*d* is a second direction D2. The direction in which the pair of side surfaces 2*e* and 2*f* face each other is a third direction D3. In the present embodiment, the first direction D1 is the height direction of the element body 2. The second direction D2 is the longitudinal direction of the element body 2 and is orthogonal to the first direction D1. The third direction D3 is the width direction of the element body 2 and is orthogonal to the first direction D1 and the second direction D2.

The pair of end surfaces 2*a* and 2*b* extend in the first direction D1 so as to interconnect the pair of main surfaces 2*c* and 2*d*. The pair of end surfaces 2*a* and 2*b* also extend in the third direction D3, that is, the short side direction of the pair of main surfaces 2*c* and 2*d*. The pair of side surfaces 2*e* and 2*f* extend in the first direction D1 so as to interconnect the pair of main surfaces 2*c* and 2*d*. The pair of side surfaces 2*e* and 2*f* also extend in the second direction D2, that is, the long side direction of the pair of end surfaces 2*a* and 2*b*. The multilayer coil component 1 is, for example, solder-mounted onto an electronic device (such as a circuit board and an electronic component). In the multilayer coil component 1, the main surface (one main surface) 2*d* constitutes a mounting surface facing the electronic device.

Figure 2:
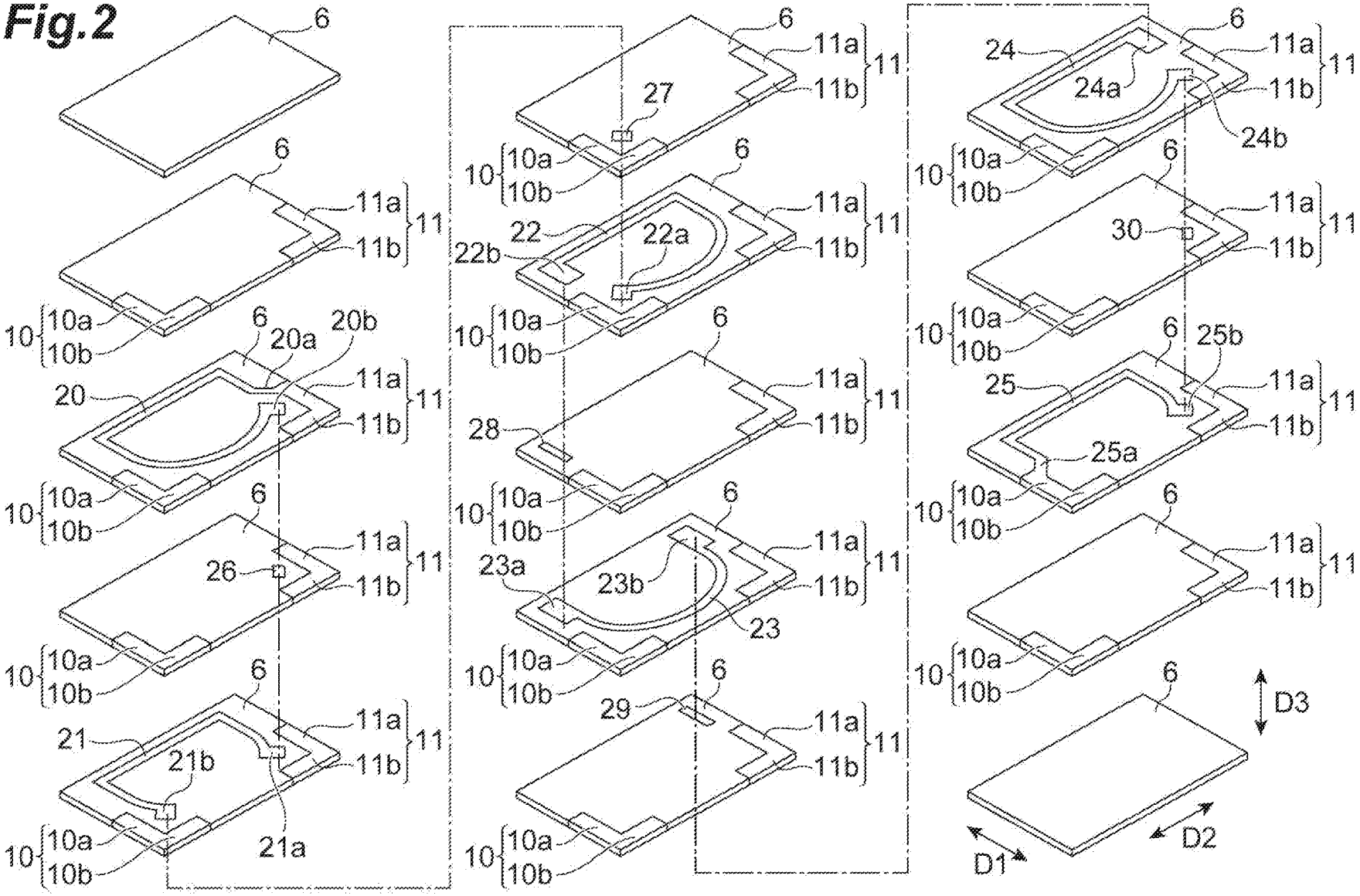
FIG. 2 is an exploded perspective view of an element body of the multilayer coil component illustrated in FIG. 1.

As illustrated in FIG. 2, the element body 2 is configured by a plurality of dielectric layers 6 being stacked in the third direction D3. The element body 2 has the plurality of stacked dielectric layers 6. In the element body 2, the stacking direction of the plurality of dielectric layers 6 coincides with the third direction D3. In the actual element body 2, each dielectric layer 6 is integrated to the extent that the boundaries between the dielectric layers 6 cannot be visually recognized. Each dielectric layer 6 is formed of a dielectric material containing a glass component. In other words, the element body 2 contains a dielectric material containing a glass component as a compound of elements constituting the element body 2. Examples of the glass component include borosilicate glass. The dielectric material is dielectric ceramic such as $BaTiO_3$-based dielectric ceramic, $Ba(Ti,Zr)O_3$-based dielectric ceramic, and $(Ba,Ca)TiO_3$-based dielectric ceramic. Each dielectric layer 6 is made of a sintered body of a ceramic green sheet containing a glass ceramic material. It should be noted that each dielectric layer 6 may be made of a magnetic material. Examples of the magnetic material include a Ni—Cu—Zn-based ferrite material, a Ni—Cu—Zn—Mg-based ferrite material, and a Ni—Cu-based ferrite material. The magnetic material that constitutes each dielectric layer 6 may include a Fe alloy. Each dielectric layer 6 may be made of a non-magnetic material.

Examples of the non-magnetic material include a glass ceramic material and a dielectric material.

Figure 3:
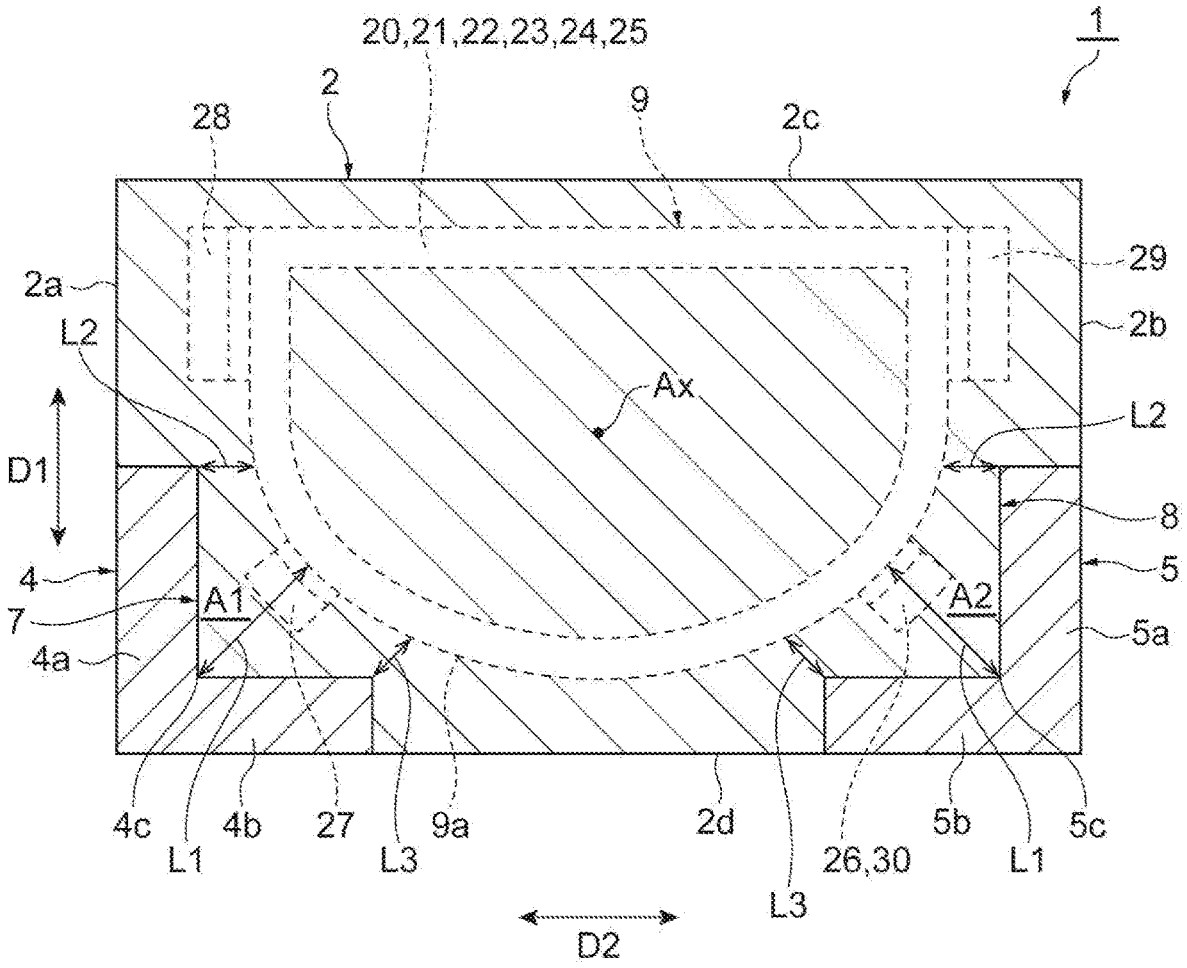
FIG. 3 is a cross-sectional view illustrating the configuration of the multilayer coil component illustrated in FIG. 1.

As illustrated in FIG. 3, the terminal electrode 4 is disposed on the end surface 2*a* side of the element body 2. The terminal electrode 5 is disposed on the end surface 2*b* side of the element body 2. The pair of terminal electrodes 4 and 5 are separated from each other in the second direction D2. Each of the terminal electrodes 4 and 5 is embedded in the element body 2. The terminal electrodes 4 and 5 are respectively disposed in recess portions 7 and 8 formed in the element body 2. The terminal electrode 4 is disposed over the end surface 2*a* and the main surface 2*d*. The terminal electrode 5 is disposed over the end surface 2*b* and the main surface 2*d*. In the present embodiment, the surface of the terminal electrode 4 is substantially flush with each of the end surface 2*a* and the main surface 2*d*. The surface of the terminal electrode 5 is substantially flush with each of the end surface 2*b* and the main surface 2*d*.

Each of the terminal electrodes 4 and 5 contains a conductive material. The conductive material contains, for example, Ag or Pd. Each of the terminal electrodes 4 and 5 is configured as a sintered body of conductive paste containing conductive material powder. Examples of the conductive material powder include Ag powder and Pd powder. A plating layer may be formed on the surface of each of the terminal electrodes 4 and 5. The plating layer is formed by, for example, electroplating or electroless plating. The plating layer contains, for example, Ni, Sn, or Au.

The terminal electrode 4 has an L shape when viewed from the third direction D3. The terminal electrode 4 has a plurality of electrode parts 4*a* and 4*b*. In the present embodiment, the terminal electrode 4 has a pair of electrode parts 4*a* and 4*b*. The electrode part (first part) 4*a* and the electrode part (second part) 4*b* are connected in the ridge line portion of the element body 2 and are electrically connected to each other. In the present embodiment, the electrode part 4*a* and the electrode part 4*b* are integrally formed. The electrode part 4*a* extends along the first direction D1. The electrode part 4*a* has a rectangular shape when viewed from the second direction D2. The electrode part 4*b* extends along the second direction D2. The electrode part 4*b* has a rectangular shape when viewed from the first direction D1. Each of the electrode parts 4*a* and 4*b* extends along the third direction D3.

As illustrated in FIG. 2, the terminal electrode 4 is configured by a plurality of electrode layers 10 being stacked. In the present embodiment, the terminal electrode 4 has the plurality of stacked electrode layers 10. In the present embodiment, the number of the electrode layers 10 is "13". Each electrode layer 10 is provided in a defective portion formed in the corresponding dielectric layer 6. The electrode layer 10 is formed by conductive paste positioned in a defective portion formed in a green sheet being fired. The green sheet and the conductive paste are fired at the same time. Accordingly, the electrode layer 10 is obtained from the conductive paste when the dielectric layer 6 is obtained from the green sheet. In the actual terminal electrode 4, each electrode layer 10 is integrated to the extent that the boundaries between the electrode layers 10 cannot be visually recognized. The recess portion 7 of the fired element body 2 where the terminal electrode 4 is disposed is obtained by the defective portion formed in the green sheet.

Each electrode layer 10 has an L shape when viewed from the third direction D3. The electrode layer 10 has a plurality of layer parts 10*a* and 10*b*. The layer part 10*a* extends along the first direction D1. The layer part 10*b* extends along the second direction D2. The electrode part 4*a* is configured by the layer part 10*a* of each electrode layer 10 being stacked. At the electrode part 4*a*, the layer part 10*a* is integrated to the extent that the boundary between the layer parts 10*a* cannot be visually recognized. The electrode part 4*b* is configured by the layer part 10*b* of each electrode layer 10 being stacked. At the electrode part 4*b*, the layer part 10*b* is integrated to the extent that the boundary between the layer parts 10*b* cannot be visually recognized.

As illustrated in FIG. 3, the terminal electrode 5 has an L shape when viewed from the third direction D3. The terminal electrode 5 has a plurality of electrode parts 5*a* and 5*b*. In the present embodiment, the terminal electrode 5 has a pair of electrode parts 5*a* and 5*b*. The electrode part (first part) 5*a* and the electrode part (second part) 5*b* are connected in the ridge line portion of the element body 2 and are electrically connected to each other. In the present embodiment, the electrode part 5*a* and the electrode part 5*b* are integrally formed. The electrode part 5*a* extends along the first direction D1. The electrode part 5*a* has a rectangular shape when viewed from the second direction D2. The electrode part 5*b* extends along the second direction D2. The electrode part 5*b* has a rectangular shape when viewed from the first direction D1. Each of the electrode parts 5*a* and 5*b* extends along the third direction D3.

As illustrated in FIG. 2, the terminal electrode 5 is configured by a plurality of electrode layers 11 being stacked. In the present embodiment, the terminal electrode 5 has the plurality of stacked electrode layers 11. In the present embodiment, the number of the electrode layers 11 is "13". Each electrode layer 11 is provided in a defective portion formed in the corresponding dielectric layer 6. The electrode layer 11 is formed by conductive paste positioned in a defective portion formed in a green sheet being fired. The green sheet and the conductive paste are fired at the same time as described above. Accordingly, the electrode layer 10 is obtained and the electrode layer 11 is obtained from the conductive paste when the dielectric layer 6 is obtained from the green sheet. In the actual terminal electrode 5, each electrode layer 11 is integrated to the extent that the boundaries between the electrode layers 11 cannot be visually recognized. The recess portion 8 of the fired element body 2 where the terminal electrode 5 is disposed is obtained by the defective portion formed in the green sheet.

Each electrode layer 11 has an L shape when viewed from the third direction D3. The electrode layer 11 has a plurality of layer parts 11*a* and 11*b*. The layer part 11*a* extends along the first direction D1. The layer part 11*b* extends along the second direction D2. The electrode part 5*a* is configured by the layer part 11*a* of each electrode layer 11 being stacked. At the electrode part 5*a*, the layer part 11*a* is integrated to the extent that the boundary between the layer parts 11*a* cannot be visually recognized. The electrode part 5*b* is configured by the layer part 11*b* of each electrode layer 11 being stacked. At the electrode part 5*b*, the layer part 11*b* is integrated to the extent that the boundary between the layer parts 11*b* cannot be visually recognized.

The multilayer coil component 1 includes a coil 9 disposed in the element body 2 as illustrated in FIG. 3. A coil axis Ax of the coil 9 extends along the third direction D3. The coil 9 has a substantially semicircular shape when viewed from the third direction D3. Specifically, the part of the coil 9 that overlaps the terminal electrodes 4 and 5 when viewed from the second direction D2 has a shape in which the outer shape of an outer edge 9*a* in the second direction D2 becomes small from the main surface (the other main surface) 2*c* toward the main surface 2*d* when viewed from the third direction D3. The part of the coil 9 that faces the terminal electrode 4 and the terminal electrode 5 is curved. When viewed from the third direction D3, the outer edge 9*a* of the coil 9 is separated from the terminal electrode 4 and the terminal electrode 5.

Specifically, when viewed from the third direction D3, a first distance L1 that is the shortest distance between the outer edge 9*a* of the coil 9 and a corner portion 4*c* formed by the electrode part 4*a* and the electrode part 4*b* of the terminal electrode 4 is larger than a second distance L2 that is the shortest distance between the outer edge 9*a* of the coil 9 and the electrode part 4*a* (for example, the corner portion of the electrode part 4*a*) and a third distance L3 that is the shortest distance between the outer edge 9*a* of the coil 9 and the electrode part 4*b* (for example, the corner portion of the electrode part 4*b*). The terminal electrode 4 and the outer edge 9*a* of the coil 9 are most separated from each other at the position of the corner portion 4*c* of the terminal electrode 4. As a result, a first region A1 is formed between the terminal electrode 4 and the coil 9. Likewise, when viewed from the third direction D3, the first distance L1 that is the shortest distance between the outer edge 9*a* of the coil 9 and a corner portion 5*c* formed by the electrode part 5*a* and the electrode part 5*b* of the terminal electrode 5 is larger than the second distance L2 that is the shortest distance between the electrode part 5*a* and the outer edge 9*a* of the coil 9 and the third distance L3 that is the shortest distance between the electrode part 5*b* and the outer edge 9*a* of the coil 9. A second region A2 is formed between the terminal electrode 5 and the coil 9.

As illustrated in FIG. 2, the coil 9 has a first coil conductor 20, a second coil conductor 21, a third coil conductor 22, a fourth coil conductor 23, a fifth coil conductor 24, and a sixth coil conductor 25. The first coil conductor 20, the second coil conductor 21, the third coil conductor 22, the fourth coil conductor 23, the fifth coil conductor 24, and the sixth coil conductor 25 are disposed along the third direction D3 in the order of the first coil conductor 20, the second coil conductor 21, the third coil conductor 22, the fourth coil conductor 23, the fifth coil conductor 24, and the sixth coil conductor 25. The first coil conductor 20, the second coil conductor 21, the third coil conductor 22, the fourth coil conductor 23, the fifth coil conductor 24, and the sixth coil conductor 25 substantially have a shape in which a part of a loop is interrupted and have one end and the other end. The first coil conductor 20, the second coil conductor 21, the third coil conductor 22, the fourth coil conductor 23, the fifth coil conductor 24, and the sixth coil conductor 25 are formed with a predetermined width.

The coil 9 has a first connection conductor 26, a second connection conductor 27, a third connection conductor 28, a fourth connection conductor 29, and a fifth connection conductor 30. The first connection conductor 26, the second connection conductor 27, the third connection conductor 28, the fourth connection conductor 29, and the fifth connection conductor 30 are disposed along the third direction D3 in the order of the first connection conductor 26, the second connection conductor 27, the third connection conductor 28, the fourth connection conductor 29, and the fifth connection conductor 30.

The first coil conductor 20 is positioned in the same layer as one electrode layer 10 and one electrode layer 11. The first coil conductor 20 is connected to the electrode layer 11 via a connecting conductor 20*a*. The connecting conductor 20*a* is positioned in the same layer as the first coil conductor 20. One end of the first coil conductor 20 is connected to the connecting conductor 20*a*. The connecting conductor 20*a* is connected to the layer part 11*a*. The connecting conductor 20*a* connects the first coil conductor 20 and the electrode layer 11. The connecting conductor 20*a* may be connected to the layer part 11*b*. The first coil conductor 20 has an end provided with a connection portion 20*b*. The connection portion 20*b* is provided so as to protrude outward beyond the outer edge 9*a* of the coil 9 in the first coil conductor 20. The first coil conductor 20 is separated from the electrode layer 10 positioned in the same layer. In the present embodiment, the first coil conductor 20, the connecting conductor 20*a*, the connection portion 20*b*, and the electrode layer 11 are integrally formed.

The first connection conductor 26 is disposed in the dielectric layer 6 between the first coil conductor 20 and the second coil conductor 21. One electrode layer 10 and one electrode layer 11 are positioned in the dielectric layer 6 where the first connection conductor 26 is disposed. The first connection conductor 26 is separated from the electrode layers 10 and 11 positioned in the same layer. The first connection conductor 26 is connected to the other end of the first coil conductor 20 and is connected to one end of the second coil conductor 21. Specifically, the first connection conductor 26 is connected to the connection portion 20*b* of the first coil conductor 20 and a connection portion 21*a* of the second coil conductor 21. In other words, the first connection conductor 26 does not overlap the first coil conductor 20 and the second coil conductor 21 when viewed from the third direction D3. The first connection conductor 26 connects the first coil conductor 20 and the second coil conductor 21.

As illustrated in FIG. 3, the first connection conductor 26 is disposed in the second region A2. The second region A2 is a region between the terminal electrode 5 and the outer edge 9*a* of the coil 9 in the element body 2 when viewed from the third direction D3. In other words, the first connection conductor 26 is disposed outside the coil 9. The second region A2 is a region inside the terminal electrode 5, is a region that overlaps the terminal electrode 5 (electrode part 5*a*) when viewed from the second direction D2, and is a region that overlaps the terminal electrode 5 (electrode part 5*b*) when viewed from the first direction D1. The first connection conductor 26 is disposed apart from the terminal electrode 5. When viewed from the third direction D3, the first connection conductor 26 is disposed on a straight line that connects the corner portion 5*c* of the terminal electrode 5 and the outer edge 9*a* of the coil 9 and has the first distance L1. The first connection conductor 26 has a predetermined width.

The first connection conductor 26 has a part parallel to the outer edge 9*a* of the coil 9. The first connection conductor 26 has a longitudinal direction and a lateral direction. The first connection conductor 26 has a shape along the coil 9 in the longitudinal direction. When viewed from the third direction D3, the longitudinal-direction side of the first connection conductor 26 is parallel to the outer edge 9*a* of the coil 9. The longitudinal-direction side of the first connection conductor 26 is curved along the outer edge 9*a* of the coil 9.

As illustrated in FIG. 2, the second coil conductor 21 is positioned in the same layer as one electrode layer 10 and one electrode layer 11. The second coil conductor 21 is separated from the electrode layers 10 and 11 positioned in the same layer. The first coil conductor 20 and the second coil conductor 21 are adjacent to each other in the third direction D3 in a state where the dielectric layer 6 is interposed between the first coil conductor 20 and the second coil conductor 21. The connection portion 21*a* is provided at one end of the second coil conductor 21. A connection portion 21*b* is provided at the other end of the second coil conductor 21. The connection portion 21*a* and the connection portion 21*b* are provided so as to protrude outward beyond the outer edge 9*a* of the coil 9 in the second coil conductor 21. When viewed from the third direction D3, the connection portion 20*b* of the first coil conductor 20 and one end of the connection portion 21*a* of the second coil conductor 21 overlap each other.

The second connection conductor 27 is disposed in the dielectric layer 6 between the second coil conductor 21 and the third coil conductor 22. One electrode layer 10 and one electrode layer 11 are positioned in the dielectric layer 6 where the second connection conductor 27 is disposed. The second connection conductor 27 is separated from the electrode layers 10 and 11 positioned in the same layer. The second connection conductor 27 is connected to the other end of the second coil conductor 21 and is connected to one end of the third coil conductor 22. Specifically, the second connection conductor 27 is connected to the connection portion 21*b* of the second coil conductor 21 and a connection portion 22*a* of the third coil conductor 22. In other words, the second connection conductor 27 does not overlap the second coil conductor 21 and the third coil conductor 22 when viewed from the third direction D3. The second connection conductor 27 connects the second coil conductor 21 and the third coil conductor 22.

As illustrated in FIG. 3, the second connection conductor 27 is disposed in the first region A1. The first region A1 is a region between the terminal electrode 4 and the outer edge 9*a* of the coil 9 in the element body 2 when viewed from the third direction D3. In other words, the second connection conductor 27 is disposed outside the coil 9. The first region A1 is a region inside the terminal electrode 4, is a region that overlaps the terminal electrode 4 (electrode part 4*a*) when viewed from the second direction D2, and is a region that overlaps the terminal electrode 4 (electrode part 4*b*) when viewed from the first direction D1. The second connection conductor 27 is disposed apart from the terminal electrode 4. When viewed from the third direction D3, the second connection conductor 27 is disposed on a straight line that connects the corner portion 4*c* of the terminal electrode 4 and the outer edge 9*a* of the coil 9 and has the first distance L1. The second connection conductor 27 has a predetermined width.

The second connection conductor 27 has a part parallel to the outer edge 9*a* of the coil 9. The second connection conductor 27 has a longitudinal direction and a lateral direction. The second connection conductor 27 has a shape along the coil 9 in the longitudinal direction. When viewed from the third direction D3, the longitudinal-direction side of the second connection conductor 27 is parallel to the outer edge 9*a* of the coil 9. The longitudinal-direction side of the second connection conductor 27 is curved along the outer edge 9*a* of the coil 9.

As illustrated in FIG. 2, the third coil conductor 22 is positioned in the same layer as one electrode layer 10 and one electrode layer 11. The third coil conductor 22 is separated from the electrode layers 10 and 11 positioned in the same layer. The second coil conductor 21 and the third coil conductor 22 are adjacent to each other in the third direction D3 in a state where the dielectric layer 6 is interposed between the second coil conductor 21 and the third coil conductor 22. The connection portion 22*a* is provided at one end of the third coil conductor 22. A connection portion 22*b* is provided at the other end of the third coil conductor 22. The connection portion 22*a* and the connection portion 22*b* are provided so as to protrude outward beyond the outer edge 9*a* of the coil 9 in the third coil conductor 22. When viewed from the third direction D3, the connection portion 21*b* of the second coil conductor 21 and the connection portion 22*a* of the third coil conductor 22 overlap each other.

The third connection conductor 28 is disposed in the dielectric layer 6 between the third coil conductor 22 and the fourth coil conductor 23. One electrode layer 10 and one electrode layer 11 are positioned in the dielectric layer 6 where the third connection conductor 28 is disposed. The third connection conductor 28 is separated from the electrode layers 10 and 11 positioned in the same layer. The third connection conductor 28 is connected to the other end of the third coil conductor 22 and is connected to one end of the fourth coil conductor 23. Specifically, the third connection conductor 28 is connected to the connection portion 22*b* of the third coil conductor 22 and a connection portion 23*a* of the fourth coil conductor 23. In other words, the third connection conductor 28 does not overlap the third coil conductor 22 and the fourth coil conductor 23 when viewed from the third direction D3. The third connection conductor 28 connects the third coil conductor 22 and the fourth coil conductor 23.

The third connection conductor 28 is disposed in a region outside the coil 9. The third connection conductor 28 has a predetermined width. The third connection conductor 28 has a rectangular shape. The third connection conductor 28 extends along the first direction D1.

As illustrated in FIG. 2, the fourth coil conductor 23 is positioned in the same layer as one electrode layer 10 and one electrode layer 11. The fourth coil conductor 23 is separated from the electrode layers 10 and 11 positioned in the same layer. The third coil conductor 22 and the fourth coil conductor 23 are adjacent to each other in the third direction D3 in a state where the dielectric layer 6 is interposed between the third coil conductor 22 and the fourth coil conductor 23. The connection portion 23*a* is provided at one end of the fourth coil conductor 23. A connection portion 23*b* is provided at the other end of the fourth coil conductor 23. The connection portion 23*a* and the connection portion 23*b* are provided so as to protrude outward beyond the outer edge 9*a* of the coil 9 in the fourth coil conductor 23. When viewed from the third direction D3, the connection portion 22*b* of the third coil conductor 22 and the connection portion 23*a* of the fourth coil conductor 23 overlap each other.

The fourth connection conductor 29 is disposed in the dielectric layer 6 between the fourth coil conductor 23 and the fifth coil conductor 24. One electrode layer 10 and one electrode layer 11 are positioned in the dielectric layer 6 where the fourth connection conductor 29 is disposed. The fourth connection conductor 29 is separated from the electrode layers 10 and 11 positioned in the same layer. The fourth connection conductor 29 is connected to the other end of the fourth coil conductor 23 and is connected to one end of the fifth coil conductor 24. Specifically, the fourth connection conductor 29 is connected to the connection portion 23*b* of the fourth coil conductor 23 and a connection portion 24*a* of the fifth coil conductor 24. In other words, the fourth connection conductor 29 does not overlap the fourth coil conductor 23 and the fifth coil conductor 24 when viewed from the third direction D3. The fourth connection conductor 29 connects the fourth coil conductor 23 and the fifth coil conductor 24.

The fourth connection conductor 29 is disposed in a region outside the coil 9. The fourth connection conductor 29 has a predetermined width. The fourth connection conductor 29 has a rectangular shape. The fourth connection conductor 29 extends along the first direction D1.

The fifth coil conductor 24 is positioned in the same layer as one electrode layer 10 and one electrode layer 11. The fifth coil conductor 24 is separated from the electrode layers 10 and 11 positioned in the same layer. The fourth coil conductor 23 and the fifth coil conductor 24 are adjacent to each other in the third direction D3 in a state where the dielectric layer 6 is interposed between the fourth coil conductor 23 and the fifth coil conductor 24. The connection portion 24*a* is provided at one end of the fifth coil conductor 24. A connection portion 24*b* is provided at the other end of the fifth coil conductor 24. The connection portion 24*a* and the connection portion 24*b* are provided so as to protrude outward beyond the outer edge 9*a* of the coil 9 in the fifth coil conductor 24. When viewed from the third direction D3, the connection portion 23*b* of the fourth coil conductor 23 and the connection portion 24*a* of the fifth coil conductor 24 overlap each other.

The fifth connection conductor 30 is disposed in the dielectric layer 6 between the fifth coil conductor 24 and the sixth coil conductor 25. One electrode layer 10 and one electrode layer 11 are positioned in the dielectric layer 6 where the fifth connection conductor 30 is disposed. The fifth connection conductor 30 is separated from the electrode layers 10 and 11 positioned in the same layer. The fifth connection conductor 30 is connected to the other end of the fifth coil conductor 24 and is connected to one end of the sixth coil conductor 25. Specifically, the fifth connection conductor 30 is connected to the connection portion 24*b* of the fifth coil conductor 24 and a connection portion 25*b* of the sixth coil conductor 25. In other words, the fifth connection conductor 30 does not overlap the fifth coil conductor 24 and the sixth coil conductor 25 when viewed from the third direction D3. The fifth connection conductor 30 connects the fifth coil conductor 24 and the sixth coil conductor 25. As illustrated in FIG. 3, the fifth connection conductor 30 is disposed in the second region A2. The fifth connection conductor 30 has the same shape as the first connection conductor 26.

As illustrated in FIG. 2, the sixth coil conductor 25 is positioned in the same layer as one electrode layer 10 and one electrode layer 11. The sixth coil conductor 25 is connected to the electrode layer 10 via a connecting conductor 25*a*. The connecting conductor 25*a* is positioned in the same layer as the sixth coil conductor 25. The other end of the sixth coil conductor 25 is connected to the connecting conductor 25*a*. The connecting conductor 25*a* is connected to the layer part 10*a*. The connecting conductor 25*a* connects the sixth coil conductor 25 and the electrode layer 10. The connecting conductor 25*a* may be connected to the layer part 10*b*. The sixth coil conductor 25 has an end provided with the connection portion 25*b*. The connection portion 25*b* is provided so as to protrude outward beyond the outer edge 9*a* of the coil 9 in the sixth coil conductor 25. The sixth coil conductor 25 is separated from the electrode layer 11 positioned in the same layer. In the present embodiment, the sixth coil conductor 25, the connecting conductor 25*a*, the connection portion 25*b*, and the electrode layer 10 are integrally formed.

The first coil conductor 20, the second coil conductor 21, the third coil conductor 22, the fourth coil conductor 23, the fifth coil conductor 24, and the sixth coil conductor 25 are electrically connected through the first connection conductor 26, the second connection conductor 27, the third connection conductor 28, the fourth connection conductor 29, and the fifth connection conductor 30. The first coil conductor 20, the second coil conductor 21, the third coil conductor 22, the fourth coil conductor 23, the fifth coil conductor 24, and the sixth coil conductor 25 constitute the coil 9. The coil 9 is electrically connected to the terminal electrode 5 through the connecting conductor 20*a*. The coil 9 is electrically connected to the terminal electrode 4 through the connecting conductor 25*a*.

The first coil conductor 20, the second coil conductor 21, the third coil conductor 22, the fourth coil conductor 23, the fifth coil conductor 24, the sixth coil conductor 25, the connecting conductors 20*a* and 25*a*, the first connection conductor 26, the second connection conductor 27, the third connection conductor 28, the fourth connection conductor 29, and the fifth connection conductor 30 contain a conductive material. The conductive material contains Ag or Pd. The first coil conductor 20, the second coil conductor 21, the third coil conductor 22, the fourth coil conductor 23, the fifth coil conductor 24, the connecting conductors 20*a* and 25*a*, the first connection conductor 26, the second connection conductor 27, the third connection conductor 28, the fourth connection conductor 29, and the fifth connection conductor 30 are configured as a sintered body of conductive paste containing conductive material powder. Examples of the conductive material powder include Ag powder and Pd powder.

In the present embodiment, the first coil conductor 20, the second coil conductor 21, the third coil conductor 22, the fourth coil conductor 23, the fifth coil conductor 24, the sixth coil conductor 25, the connecting conductors 20*a* and 25*a*, the first connection conductor 26, the second connection conductor 27, the third connection conductor 28, the fourth connection conductor 29, and the fifth connection conductor 30 contain the same conductive material as each of the terminal electrodes 4 and 5. The first coil conductor 20, the second coil conductor 21, the third coil conductor 22, the fourth coil conductor 23, the fifth coil conductor 24, the connecting conductors 20*a* and 25*a*, the first connection conductor 26, the second connection conductor 27, the third connection conductor 28, the fourth connection conductor 29, and the fifth connection conductor 30 may contain a conductive material different from the conductive material of each of the terminal electrodes 4 and 5.

The first coil conductor 20, the second coil conductor 21, the third coil conductor 22, the fourth coil conductor 23, the fifth coil conductor 24, the sixth coil conductor 25, the connecting conductors 20*a* and 25*a*, the first connection conductor 26, the second connection conductor 27, the third connection conductor 28, the fourth connection conductor 29, and the fifth connection conductor 30 are provided in a defective portion formed in the corresponding dielectric layer 6. The first coil conductor 20, the second coil conductor 21, the third coil conductor 22, the fourth coil conductor 23, the fifth coil conductor 24, the sixth coil conductor 25, the connecting conductors 20*a* and 25*a*, the first connection conductor 26, the second connection conductor 27, the third connection conductor 28, the fourth connection conductor 29, and the fifth connection conductor 30 are formed by conductive paste positioned in a defective portion formed in a green sheet being fired. The green sheet and the conductive paste are fired at the same time as described above. Accordingly, the first coil conductor 20, the second coil conductor 21, the third coil conductor 22, the fourth coil conductor 23, the fifth coil conductor 24, the connecting conductors 20*a* and 25*a*, the first connection conductor 26, the second connection conductor 27, the third connection conductor 28, the fourth connection conductor 29, and the fifth connection conductor 30 are obtained from the conductive paste when the dielectric layer 6 is obtained from the green sheet.

The defective portion formed in the green sheet is formed by, for example, the following process. First, a green sheet is formed by element body paste containing a constituent material of the dielectric layer 6 and a photosensitive material being applied onto a base material. The base material is, for example, a PET film. The photosensitive material contained in the element body paste may be either a negative-type photosensitive material or a positive-type photosensitive material, and a known material can be used as the photosensitive material. Next, the green sheet is exposed and developed by the photolithography method by means of a mask corresponding to the defective portion and the defective portion is formed in the green sheet on the base material. The green sheet where the defective portion is formed is an element body pattern.

The electrode layers 10 and 11, the first coil conductor 20, the second coil conductor 21, the third coil conductor 22, the fourth coil conductor 23, the fifth coil conductor 24, the connecting conductors 20*a* and 25*a*, the first connection conductor 26, the second connection conductor 27, the third connection conductor 28, the fourth connection conductor 29, and the fifth connection conductor 30 are formed by, for example, the following process.

First, a conductor material layer is formed by conductive paste containing a photosensitive material being applied onto a base material. The photosensitive material contained in the conductive paste may be either a negative-type photosensitive material or a positive-type photosensitive material, and a known material can be used as the photosensitive material. Next, the conductor material layer is exposed and developed by the photolithography method by means of a mask corresponding to the defective portion and a conductor pattern corresponding to the shape of the defective portion is formed on the base material.

The multilayer coil component 1 is obtained by, for example, the following process that follows the process described above. A sheet in which the element body pattern and the conductor pattern are in the same layer is prepared by the conductor pattern being combined with the defective portion of the element body pattern. A stacked body is obtained by a predetermined number of the prepared sheets being stacked, heat treatment is performed on the stacked body, and then a plurality of green chips are obtained from the stacked body. In this process, a green stacked body is cut into chips by, for example, a cutting machine. As a result, a plurality of green chips having a predetermined size can be obtained. Next, the green chip is fired. The multilayer coil component 1 is obtained as a result of this firing. In the multilayer coil component 1, the terminal electrodes 4 and 5 and the coil 9 are integrally formed.

As described above, in the multilayer coil component 1 according to the present embodiment, the first connection conductor 26, the second connection conductor 27, the third connection conductor 28, the fourth connection conductor 29, and the fifth connection conductor 30 are disposed at positions that do not overlap the first coil conductor 20, the second coil conductor 21, the third coil conductor 22, the fourth coil conductor 23, and the fifth coil conductor 24 when viewed from the third direction D3. The first connection conductor 26, the second connection conductor 27, and the fifth connection conductor 30 are disposed in the first region A1 between the terminal electrode 4 and the outer edge 9*a* of the coil 9 or the second region A2 between the terminal electrode 5 and the outer edge 9*a* of the coil 9 when viewed from the third direction D3. In this manner, in the multilayer coil component 1, the positions of the first coil conductor 20, the second coil conductor 21, the third coil conductor 22, the fourth coil conductor 23, and the fifth coil conductor 24 and the positions of the first connection conductor 26, the second connection conductor 27, the third connection conductor 28, the fourth connection conductor 29, and the fifth connection conductor 30 are shifted in the stacking direction. As a result, in the multilayer coil component 1, it is possible to avoid an increase in volume attributable to stacking of the first coil conductor 20, the second coil conductor 21, the third coil conductor 22, the fourth coil conductor 23, and the fifth coil conductor 24 and the first connection conductor 26, the second connection conductor 27, the third connection conductor 28, the fourth connection conductor 29, and the fifth connection conductor 30. Accordingly, in the multilayer coil component, the occurrence of deformation can be suppressed even in a case where pressure is applied to the element body 2. Accordingly, in the multilayer coil component 1, it is possible to suppress the occurrence of a short circuit between the first coil conductor 20, the second coil conductor 21, the third coil conductor 22, the fourth coil conductor 23, and the fifth coil conductor 24 and the first connection conductor 26, the second connection conductor 27, the third connection conductor 28, the fourth connection conductor 29, and the fifth connection conductor 30.

In addition, in the multilayer coil component 1, the first region A1 or the second region A2 where the first connection conductor 26, the second connection conductor 27, and the fifth connection conductor 30 are disposed overlaps the electrode parts 4*a* and 5*a* of the terminal electrodes 4 and 5 when viewed from the second direction D2 and overlaps the electrode parts 4*b* and 5*b* when viewed from the first direction D1. In this manner, in the multilayer coil component 1, the first connection conductor 26, the second connection conductor 27, and the fifth connection conductor 30 are disposed in the first region A1 or the second region A2 inside the terminal electrodes 4 and 5, and thus a deterioration in characteristics can be suppressed as compared with a case where the first connection conductor 26, the second connection conductor 27, and the fifth connection conductor 30 are disposed inside the coil 9. As a result, in the multilayer coil component 1, it is possible to suppress a decline in reliability while realizing size reduction.

In the multilayer coil component 1, the area in which the first connection conductor 26, the second connection conductor 27, and the fifth connection conductor 30 face the terminal electrode 4 or the terminal electrode 5 is smaller than that of the first coil conductor 20, the second coil conductor 21, the third coil conductor 22, the fourth coil conductor 23, and the fifth coil conductor 24, and thus stray capacitance is hardly formed between the first connection conductor 26, the second connection conductor 27, and the fifth connection conductor 30 and the terminal electrode 4 or the terminal electrode 5. Accordingly, in the multilayer coil component 1, it is possible to suppress a deterioration in characteristics attributable to stray capacitance even in a case where the first connection conductor 26, the second connection conductor 27, and the fifth connection conductor 30 are disposed in the first region A1 or the second region A2.

In the multilayer coil component 1 according to the present embodiment, the first connection conductor 26, the second connection conductor 27, and the fifth connection conductor 30 disposed in the first region A1 or the second region A2 have a part that is parallel to the outer edge 9*a* of the coil 9 when viewed from the third direction D3. For example, in a case where the connection conductor disposed in the first region A1 or the second region A2 has a circular shape, the distance between the connection conductor and the terminal electrodes 4 and 5 decreases and the stray capacitance formed between the connection conductor and the terminal electrode 4 or 5 increases when the area of the connection conductor is increased. In the multilayer coil component 1 according to the present embodiment, it is possible to increase the distance between the terminal electrode 4 or 5 and the first connection conductor 26, the second connection conductor 27, and the fifth connection conductor 30 while ensuring the areas of the first connection conductor 26, the second connection conductor 27, and the fifth connection conductor 30 by the above-described shape being given to the first connection conductor 26, the second connection conductor 27, and the fifth connection conductor 30. Accordingly, in the multilayer coil component 1, it is possible to reliably interconnect the coil conductors and reduce the stray capacitance generated between the terminal electrodes 4 and 5 and the coil 9. As a result, it is possible to achieve an improvement in characteristics in the multilayer coil component 1.

In the multilayer coil component 1 according to the present embodiment, the part of the coil 9 that overlaps the terminal electrodes 4 and 5 when viewed from the second direction D2 has a shape in which the outer shape of the outer edge 9*a* in the second direction D2 becomes small from the main surface 2*c* toward the main surface 2*d* when viewed from the third direction D3. In this configuration, it is possible to reliably ensure the first region A1 and the second region A2 where the first connection conductor 26, the second connection conductor 27, and the fifth connection conductor 30 are disposed between the terminal electrodes 4 and 5 and the outer edge 9*a* of the coil 9.

When viewed from the third direction D3 in the multilayer coil component 1 according to the present embodiment, the first distance L1 that is the shortest distance between the outer edge 9*a* of the coil 9 and the corner portions 4*c* and 5*c* formed by the electrode parts 4*a* and 5*a* and the electrode parts 4*b* and 5*b* is larger than the second distance L2 that is the shortest distance between the electrode parts 4*a* and 5*a* and the outer edge 9*a* of the coil 9 and the third distance L3 that is the shortest distance between the electrode parts 4*b* and 5*b* and the outer edge 9*a* of the coil 9. In this configuration, it is possible to reliably ensure the first region A1 and the second region A2 where the first connection conductor 26, the second connection conductor 27, and the fifth connection conductor 30 are disposed between the terminal electrodes 4 and 5 and the outer edge 9*a* of the coil 9.

In the multilayer coil component 1 according to the present embodiment, the first connection conductor 26, the second connection conductor 27, and the fifth connection conductor 30 disposed in the first region A1 or the second region A2 are disposed on a straight line that connects the corner portions 4*c* and 5*c* of the terminal electrodes 4 and 5 and the outer edge 9*a* of the coil 9 and has the first distance L1 when viewed from the third direction D3. In this configuration, it is possible to maximize the distance between the terminal electrodes 4 and 5 and the first connection conductor 26, the second connection conductor 27, and the fifth connection conductor 30 disposed in the first region A1 or the second region A2. Accordingly, in the multilayer coil component 1, the stray capacitance generated between the terminal electrodes 4 and 5 and the coil 9 can be reduced. As a result, it is possible to achieve an improvement in characteristics in the multilayer coil component 1.

Second Embodiment

Figure 4:
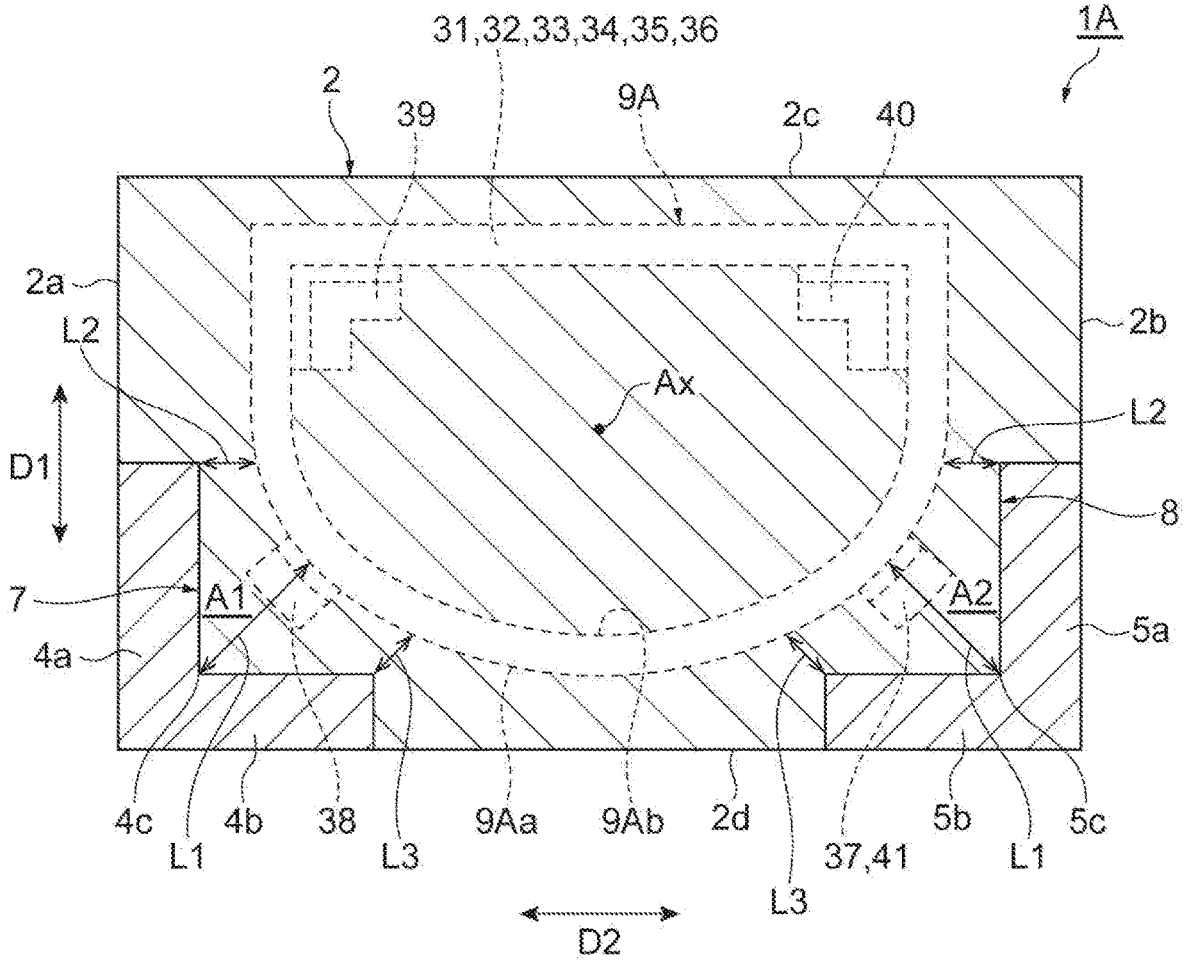
FIG. 4 is a cross-sectional view illustrating the configuration of a multilayer coil component according to a second embodiment.

Next, a second embodiment will be described. As illustrated in FIG. 4, a multilayer coil component 1A includes the element body 2 having a rectangular parallelepiped shape and a pair of terminal electrodes 4A and 5A.

The multilayer coil component 1A includes a coil 9A disposed in the element body 2. The coil axis Ax of the coil 9A extends along the third direction D3. The coil 9A has a substantially semicircular shape when viewed from the third direction D3. The part of the coil 9A that faces the terminal electrode 4 and the terminal electrode 5 is curved. When viewed from the third direction D3, an outer edge 9Aa of the coil 9A is separated from the terminal electrode 4 and the terminal electrode 5.

Specifically, when viewed from the third direction D3, the first distance L1 that is the shortest distance between the outer edge 9Aa of the coil 9A and the corner portion 4*c* formed by the electrode part 4*a* and the electrode part 4*b* of the terminal electrode 4 is larger than the second distance L2 that is the shortest distance between the outer edge 9Aa of the coil 9A and the electrode part 4*a* (for example, the corner portion of the electrode part 4*a*) and the third distance L3 that is the shortest distance between the outer edge 9Aa of the coil 9A and the electrode part 4*b* (for example, the corner portion of the electrode part 4*b*). The first region A1 is formed between the terminal electrode 4 and the coil 9A. Likewise, when viewed from the third direction D3, the first distance L1 that is the shortest distance between the outer edge 9Aa of the coil 9A and the corner portion 5*c* formed by the electrode part 5*a* and the electrode part 5*b* of the terminal electrode 5 is larger than the second distance L2 that is the shortest distance between the electrode part 5*a* and the outer edge 9Aa of the coil 9A and the third distance L3 that is the shortest distance between the electrode part 5*b* and the outer edge 9Aa of the coil 9A. The second region A2 is formed between the terminal electrode 5 and the coil 9A.

Figure 5:
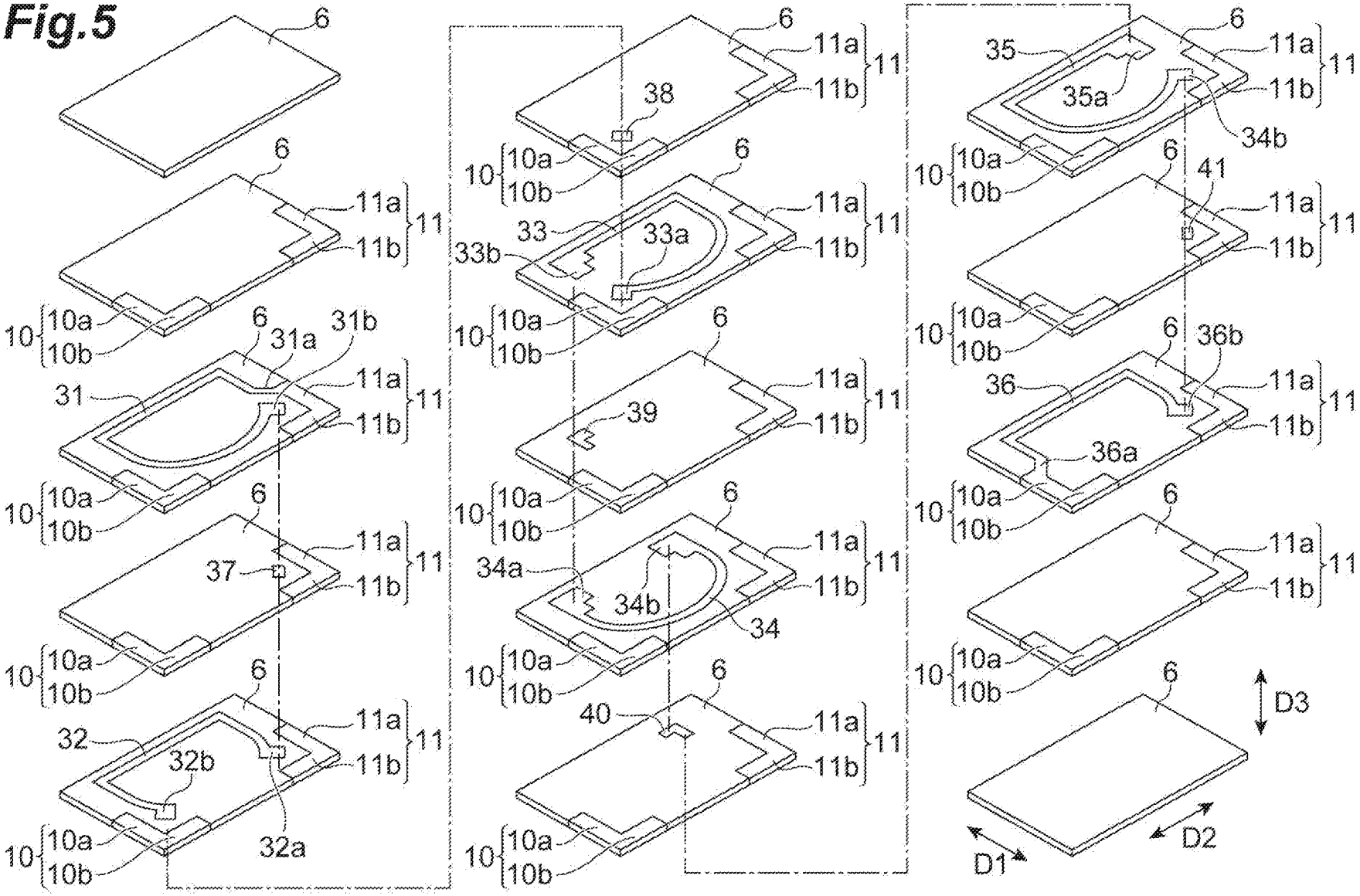
FIG. 5 is an exploded perspective view of the element body of the multilayer coil component illustrated in FIG. 4.

As illustrated in FIG. 5, the coil 9A has a first coil conductor 31, a second coil conductor 32, a third coil conductor 33, a fourth coil conductor 34, a fifth coil conductor 35, and a sixth coil conductor 36. The first coil conductor 31, the second coil conductor 32, the third coil conductor 33, the fourth coil conductor 34, the fifth coil conductor 35, and the sixth coil conductor 36 are disposed along the third direction D3 in the order of the first coil conductor 31, the second coil conductor 32, the third coil conductor 33, the fourth coil conductor 34, the fifth coil conductor 35, and the sixth coil conductor 36. The first coil conductor 31, the second coil conductor 32, the third coil conductor 33, the fourth coil conductor 34, the fifth coil conductor 35, and the sixth coil conductor 36 substantially have a shape in which a part of a loop is interrupted and have one end and the other end. The first coil conductor 31, the second coil conductor 32, the third coil conductor 33, the fourth coil conductor 34, the fifth coil conductor 35, and the sixth coil conductor 36 are formed with a predetermined width.

The coil 9A has a first connection conductor 37, a second connection conductor 38, a third connection conductor 39, a fourth connection conductor 40, and a fifth connection conductor 41. The first connection conductor 37, the second connection conductor 38, the third connection conductor 39, the fourth connection conductor 40, and the fifth connection conductor 41 are disposed along the third direction D3 in the order of the first connection conductor 37, the second connection conductor 38, the third connection conductor 39, the fourth connection conductor 40, and the fifth connection conductor 41.

The first coil conductor 31 is positioned in the same layer as one electrode layer 10 and one electrode layer 11. The first coil conductor 31 is connected to the electrode layer 11 via a connecting conductor 31*a*. The connecting conductor 31*a* is positioned in the same layer as the first coil conductor 31. One end of the first coil conductor 31 is connected to the connecting conductor 31*a*. The connecting conductor 31*a* is connected to the layer part 11*a*. The connecting conductor 31*a* connects the first coil conductor 31 and the electrode layer 11. The connecting conductor 31*a* may be connected to the layer part 11*b*. The first coil conductor 31 has an end provided with a connection portion 31*b*. The connection portion 31*b* is provided so as to protrude outward beyond the outer edge 9Aa of the coil 9A in the first coil conductor 31. The first coil conductor 31 is separated from the electrode layer 10 positioned in the same layer. In the present embodiment, the first coil conductor 31, the connecting conductor 31*a*, the connection portion 31*b*, and the electrode layer 11 are integrally formed.

The first connection conductor 37 is disposed in the dielectric layer 6 between the first coil conductor 31 and the second coil conductor 32. One electrode layer 10 and one electrode layer 11 are positioned in the dielectric layer 6 where the first connection conductor 37 is disposed. The first connection conductor 37 is separated from the electrode layers 10 and 11 positioned in the same layer. The first connection conductor 37 is connected to the other end of the first coil conductor 31 and is connected to one end of the second coil conductor 32. Specifically, the first connection conductor 37 is connected to the connection portion 31*b* of the first coil conductor 31 and a connection portion 32*a* of the second coil conductor 32. In other words, the first connection conductor 37 does not overlap the first coil conductor 31 and the second coil conductor 32 when viewed from the third direction D3. The first connection conductor 37 connects the first coil conductor 31 and the second coil conductor 32. As illustrated in FIG. 4, the first connection conductor 37 is disposed in the second region A2. The first connection conductor 37 has the same configuration as the first connection conductor 26.

As illustrated in FIG. 5, the second coil conductor 32 is positioned in the same layer as one electrode layer 10 and one electrode layer 11. The second coil conductor 32 is separated from the electrode layers 10 and 11 positioned in the same layer. The first coil conductor 31 and the second coil conductor 32 are adjacent to each other in the third direction D3 in a state where the dielectric layer 6 is interposed between the first coil conductor 31 and the second coil conductor 32. The connection portion 32*a* is provided at one end of the second coil conductor 32. A connection portion 32*b* is provided at the other end of the second coil conductor 32. The connection portion 32*a* and the connection portion 32*b* are provided so as to protrude outward beyond the outer edge 9Aa of the coil 9A in the second coil conductor 32. When viewed from the third direction D3, the connection portion 31*b* of the first coil conductor 31 and one end of the connection portion 32*a* of the second coil conductor 32 overlap each other.

The second connection conductor 38 is disposed in the dielectric layer 6 between the second coil conductor 32 and the third coil conductor 33. One electrode layer 10 and one electrode layer 11 are positioned in the dielectric layer 6 where the second connection conductor 38 is disposed. The second connection conductor 38 is separated from the electrode layers 10 and 11 positioned in the same layer. The second connection conductor 38 is connected to the other end of the second coil conductor 32 and is connected to one end of the third coil conductor 33. Specifically, the second connection conductor 38 is connected to the connection portion 32*b* of the second coil conductor 32 and a connection portion 33*a* of the third coil conductor 33. In other words, the second connection conductor 38 does not overlap the second coil conductor 32 and the third coil conductor 33 when viewed from the third direction D3. The second connection conductor 38 connects the second coil conductor 32 and the third coil conductor 33. As illustrated in FIG. 4, the second connection conductor 38 is disposed in the first region A1. The second connection conductor 38 has the same configuration as the second connection conductor 27.

As illustrated in FIG. 5, the third coil conductor 33 is positioned in the same layer as one electrode layer 10 and one electrode layer 11. The third coil conductor 33 is separated from the electrode layers 10 and 11 positioned in the same layer. The second coil conductor 32 and the third coil conductor 33 are adjacent to each other in the third direction D3 in a state where the dielectric layer 6 is interposed between the second coil conductor 32 and the third coil conductor 33. The connection portion 33*a* is provided at one end of the third coil conductor 33. A connection portion 33*b* is provided at the other end of the third coil conductor 33. The connection portion 33*a* is provided so as to protrude outward beyond the outer edge 9Aa of the coil 9A in the third coil conductor 33. The connection portion 33*b* is provided so as to protrude inward beyond an inner edge 9Ab of the coil 9A in the third coil conductor 33. When viewed from the third direction D3, the connection portion 32*b* of the second coil conductor 32 and the connection portion 33*a* of the third coil conductor 33 overlap each other.

The third connection conductor 39 is disposed in the dielectric layer 6 between the third coil conductor 33 and the fourth coil conductor 34. One electrode layer 10 and one electrode layer 11 are positioned in the dielectric layer 6 where the third connection conductor 39 is disposed. The third connection conductor 39 is separated from the electrode layers 10 and 11 positioned in the same layer. The third connection conductor 39 is connected to the other end of the third coil conductor 33 and is connected to one end of the fourth coil conductor 34. Specifically, the third connection conductor 39 is connected to the connection portion 33*b* of the third coil conductor 33 and a connection portion 34*a* of the fourth coil conductor 34. In other words, the third connection conductor 39 does not overlap the third coil conductor 33 and the fourth coil conductor 34 when viewed from the third direction D3. The third connection conductor 39 connects the third coil conductor 33 and the fourth coil conductor 34.

The third connection conductor 39 is disposed in a region inside the coil 9A. The third connection conductor 39 is positioned inside the inner edge 9Ab of the coil 9A. The third connection conductor 39 has a predetermined width. The third connection conductor 39 has an L shape. The third connection conductor 39 has a part extending along the first direction D1 and a part extending along the second direction D2.

The fourth coil conductor 34 is positioned in the same layer as one electrode layer 10 and one electrode layer 11. The fourth coil conductor 34 is separated from the electrode layers 10 and 11 positioned in the same layer. The third coil conductor 33 and the fourth coil conductor 34 are adjacent to each other in the third direction D3 in a state where the dielectric layer 6 is interposed between the third coil conductor 33 and the fourth coil conductor 34. The connection portion 34*a* is provided at one end of the fourth coil conductor 34. A connection portion 34*b* is provided at the other end of the fourth coil conductor 34. The connection portion 34*a* and the connection portion 34*b* are provided so as to protrude inward beyond the inner edge 9Ab of the coil 9A in the fourth coil conductor 34. When viewed from the third direction D3, the connection portion 33*b* of the third coil conductor 33 and the connection portion 34*a* of the fourth coil conductor 34 overlap each other.

The fourth connection conductor 40 is disposed in the dielectric layer 6 between the fourth coil conductor 34 and the fifth coil conductor 35. One electrode layer 10 and one electrode layer 11 are positioned in the dielectric layer 6 where the fourth connection conductor 40 is disposed. The fourth connection conductor 40 is separated from the electrode layers 10 and 11 positioned in the same layer. The fourth connection conductor 40 is connected to the other end of the fourth coil conductor 34 and is connected to one end of the fifth coil conductor 35. Specifically, the fourth connection conductor 40 is connected to the connection portion 34*b* of the fourth coil conductor 34 and a connection portion 35*a* of the fifth coil conductor 35. In other words, the fourth connection conductor 40 does not overlap the fourth coil conductor 34 and the fifth coil conductor 35 when viewed from the third direction D3. The fourth connection conductor 40 connects the fourth coil conductor 34 and the fifth coil conductor 35.

The fourth connection conductor 40 is disposed in a region inside the coil 9A. The fourth connection conductor 40 is positioned inside the inner edge 9Ab of the coil 9A. The fourth connection conductor 40 has a predetermined width. The fourth connection conductor 40 has an L shape. The fourth connection conductor 40 has a part extending along the first direction D1 and a part extending along the second direction D2.

The fifth coil conductor 35 is positioned in the same layer as one electrode layer 10 and one electrode layer 11. The fifth coil conductor 35 is separated from the electrode layers 10 and 11 positioned in the same layer. The fourth coil conductor 34 and the fifth coil conductor 35 are adjacent to each other in the third direction D3 in a state where the dielectric layer 6 is interposed between the fourth coil conductor 34 and the fifth coil conductor 35. The connection portion 35*a* is provided at one end of the fifth coil conductor 35. A connection portion 35*b* is provided at the other end of the fifth coil conductor 35. The connection portion 35*a* is provided so as to protrude inward beyond the inner edge 9Ab of the coil 9A in the fifth coil conductor 35. The connection portion 35*b* is provided so as to protrude outward beyond the outer edge 9Aa of the coil 9A in the fifth coil conductor 35. When viewed from the third direction D3, the connection portion 34*b* of the fourth coil conductor 34 and the connection portion 35*b* of the fifth coil conductor 35 overlap each other.

The fifth connection conductor 41 is disposed in the dielectric layer 6 between the fifth coil conductor 35 and the sixth coil conductor 36. One electrode layer 10 and one electrode layer 11 are positioned in the dielectric layer 6 where the fifth connection conductor 41 is disposed. The fifth connection conductor 41 is separated from the electrode layers 10 and 11 positioned in the same layer. The fifth connection conductor 41 is connected to the other end of the fifth coil conductor 35 and is connected to one end of the sixth coil conductor 36. Specifically, the fifth connection conductor 41 is connected to the connection portion 35*b* of the fifth coil conductor 35 and a connection portion 36*b* of the sixth coil conductor 36. In other words, the fifth connection conductor 41 does not overlap the fifth coil conductor 35 and the sixth coil conductor 36 when viewed from the third direction D3. The fifth connection conductor 41 connects the fifth coil conductor 35 and the sixth coil conductor 36. As illustrated in FIG. 4, the fifth connection conductor 41 is disposed in the second region A2. The fifth connection conductor 41 has the same configuration as the first connection conductor 37.

As illustrated in FIG. 5, the sixth coil conductor 36 is positioned in the same layer as one electrode layer 10 and one electrode layer 11. The sixth coil conductor 36 is connected to the electrode layer 10 via a connecting conductor 36*a*. The connecting conductor 36*a* is positioned in the same layer as the sixth coil conductor 36. The other end of the sixth coil conductor 36 is connected to the connecting conductor 36*a*. The connecting conductor 36*a* is connected to the layer part 10*a*. The connecting conductor 36*a* connects the sixth coil conductor 36 and the electrode layer 10. The connecting conductor 36*a* may be connected to the layer part 10*b*. The sixth coil conductor 36 has an end provided with the connection portion 36*b*. The connection portion 36*b* is provided so as to protrude outward beyond the outer edge 9Aa of the coil 9A in the sixth coil conductor 36. The sixth coil conductor 36 is separated from the electrode layer 11 positioned in the same layer. In the present embodiment, the sixth coil conductor 36, a connecting conductor 36*a*, and the electrode layer 10 are integrally formed.

The first coil conductor 31, the second coil conductor 32, the third coil conductor 33, the fourth coil conductor 34, the fifth coil conductor 35, and the sixth coil conductor 36 are electrically connected through the first connection conductor 37, the second connection conductor 38, the third connection conductor 39, the fourth connection conductor 40, and the fifth connection conductor 41. The first coil conductor 31, the second coil conductor 32, the third coil conductor 33, the fourth coil conductor 34, the fifth coil conductor 35, and the sixth coil conductor 36 constitute the coil 9A. The coil 9A is electrically connected to the terminal electrode 5 through the connecting conductor 31*a*. The coil 9A is electrically connected to the terminal electrode 4 through the connecting conductor 36*a*.

In the multilayer coil component 1A according to the present embodiment, it is possible to suppress a decline in reliability while realizing size reduction as described above and as in the multilayer coil component 1.

Third Embodiment

Figure 6:
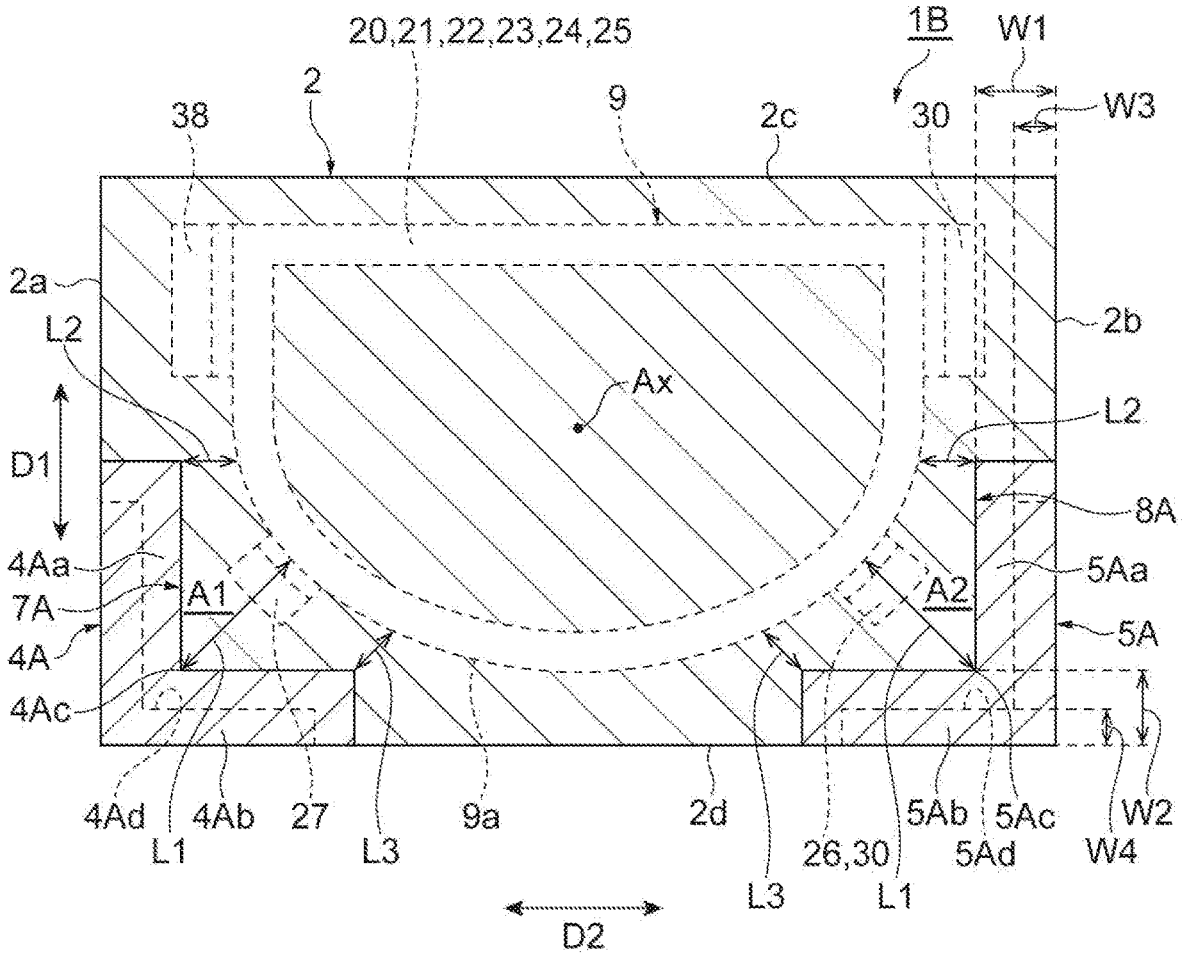
FIG. 6 is a cross-sectional view illustrating the configuration of a multilayer coil component according to a third embodiment.

Next, a third embodiment will be described. As illustrated in FIG. 6, a multilayer coil component 1B includes the element body 2 having a rectangular parallelepiped shape and the pair of terminal electrodes 4A and 5A.

The terminal electrode 4A has an L shape when viewed from the third direction D3. The terminal electrode 4A has a plurality of electrode parts 4Aa and 4Ab. The electrode part 4Aa and the electrode part 4Ab are connected in the ridge line portion of the element body 2 and are electrically connected to each other. In the present embodiment, the electrode part 4Aa and the electrode part 4Ab are integrally formed. The electrode part 4Aa extends along the first direction D1. The electrode part 4Aa has a rectangular shape when viewed from the second direction D2. The electrode part 4Ab extends along the second direction D2. The electrode part 4Ab has a rectangular shape when viewed from the first direction D1. Each of the electrode parts 4Aa and 4Ab extends along the third direction D3. An unevenness 4Ad is formed at the part of the terminal electrode 4A that faces the element body 2. As for the unevenness 4Ad, projecting and recessed parts are continuously formed in the third direction D3.

Figure 7:
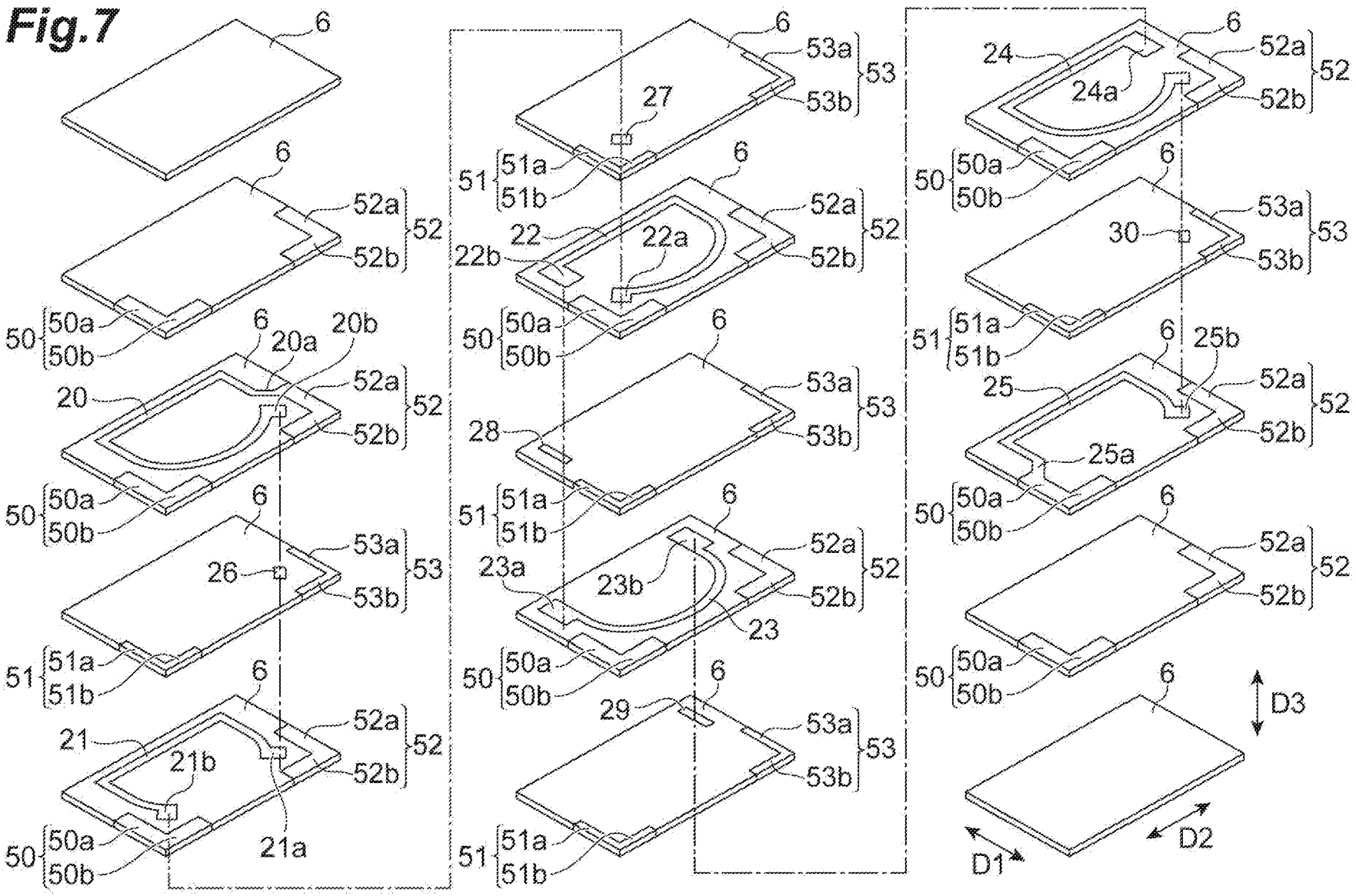
FIG. 7 is an exploded perspective view of the element body of the multilayer coil component illustrated in FIG. 6.

As illustrated in FIG. 7, the terminal electrode 4A is configured by a plurality of electrode layers (second electrode layers) 50 and a plurality of electrode layers (first electrode layers) 51 being stacked. In the present embodiment, the terminal electrode 4A has the plurality of electrode layers 50 and the plurality of electrode layers 51 that are stacked. In the present embodiment, the number of the electrode layers 50 is "8". The number of the electrode layers 51 is "5". Each of the electrode layers 50 and 51 is provided in a defective portion formed in the corresponding dielectric layer 6. The electrode layers 50 and 51 are formed by conductive paste positioned in a defective portion formed in a green sheet being fired. The green sheet and the conductive paste are fired at the same time. Accordingly, the electrode layers 50 and 51 are obtained from the conductive paste when the dielectric layer 6 is obtained from the green sheet. In the actual terminal electrode 4A, each of the electrode layers 50 and 51 is integrated to the extent that the boundaries between each of the electrode layers 50 and 51 cannot be visually recognized. A recess portion 7A of the fired element body 2 where the terminal electrode 4A is disposed is obtained by the defective portion formed in the green sheet.

Each electrode layer 50 has an L shape when viewed from the third direction D3. The electrode layer 50 has a plurality of layer parts 50*a* and 50*b*. In the present embodiment, the electrode layer 50 has a pair of layer parts 50*a* and 50*b*. The layer part 50*a* extends along the first direction D1. The layer part 50*b* extends along the second direction D2. Each electrode layer 51 has an L shape when viewed from the third direction D3. The electrode layer 51 has a plurality of layer parts 51*a* and 51*b*. In the present embodiment, the electrode layer 51 has a pair of layer parts 51*a* and 51*b*. The layer part 51*a* extends along the first direction D1. The layer part 51*b* extends along the second direction D2.

A width W1 of the layer part 50*a* in the second direction D2 is larger than a width W3 of the layer part 51*a* in the second direction D2. In other words, the width W3 of the layer part 51*a* in the second direction D2 is smaller than the width W1 of the layer part 50*a* in the second direction D2. A width W2 of the layer part 50*b* in the first direction D1 is larger than a width W4 of the layer part 51*b* in the first direction D1. In other words, the width W4 of the layer part 51*b* in the first direction D1 is smaller than the width W2 of the layer part 50*b* in the first direction D1. The unevenness 4Ad of the terminal electrode 4A is formed by the electrode layer 50 and the electrode layer 51 being stacked. At the electrode part 4Aa, the layer parts 50*a* and 51*a* are integrated to the extent that the boundary between the layer parts 50*a* and 51*a* cannot be visually recognized. The electrode part 4Ab is configured by the respective layer parts 50*b* and 51*b* of the electrode layers 50 and 51 being stacked. At the electrode part 4Ab, the layer parts 50*b* and 51*b* are integrated to the extent that the boundary between the layer parts 50*b* and 51*b* cannot be visually recognized.

As illustrated in FIG. 6, the terminal electrode 5A has an L shape when viewed from the third direction D3. The terminal electrode 5A has a plurality of electrode parts 5Aa and 5Ab. The electrode part 5Aa and the electrode part 5Ab are connected in the ridge line portion of the element body 2 and are electrically connected to each other. In the present embodiment, the electrode part 5Aa and the electrode part 5Ab are integrally formed. The electrode part 5Aa extends along the first direction D1. The electrode part 5Aa has a rectangular shape when viewed from the second direction D2. The electrode part 5Ab extends along the second direction D2. The electrode part 5Ab has a rectangular shape when viewed from the first direction D1. Each of the electrode parts 5Aa and 5Ab extends along the third direction D3. An unevenness 5Ad is formed at the part of the terminal electrode 5A that faces the element body 2. As for the unevenness 5Ad, projecting and recessed parts are continuously formed in the third direction D3.

As illustrated in FIG. 7, the terminal electrode 5A is configured by a plurality of electrode layers 52 and a plurality of electrode layers 53 being stacked. In the present embodiment, the terminal electrode 5A has the plurality of electrode layers 52 and the plurality of electrode layers 53 that are stacked. In the present embodiment, the number of the electrode layers 52 is "8". The number of the electrode layers 53 is "5". Each of the electrode layers 52 and 53 is provided in a defective portion formed in the corresponding dielectric layer 6. The electrode layers 52 and 53 are formed by conductive paste positioned in a defective portion formed in a green sheet being fired. The green sheet and the conductive paste are fired at the same time. Accordingly, the electrode layers 52 and 53 are obtained from the conductive paste when the dielectric layer 6 is obtained from the green sheet. In the actual terminal electrode 5A, each of the electrode layers 52 and 53 is integrated to the extent that the boundaries between each of the electrode layers 52 and 53 cannot be visually recognized. A recess portion 8A of the fired element body 2 where the terminal electrode 5A is disposed is obtained by the defective portion formed in the green sheet.

Each electrode layer 52 has an L shape when viewed from the third direction D3. The electrode layer 52 has a plurality of layer parts 52*a* and 52*b*. In the present embodiment, the electrode layer 52 has a pair of layer parts 52*a* and 52*b*. The layer part 52*a* extends along the first direction D1. The layer part 52*b* extends along the second direction D2. Each electrode layer 53 has an L shape when viewed from the third direction D3. The electrode layer 53 has a plurality of layer parts 53*a* and 53*b*. In the present embodiment, the electrode layer 53 has a pair of layer parts 53*a* and 53*b*. The layer part 53*a* extends along the first direction D1. The layer part 53*b* extends along the second direction D2.

As illustrated in FIG. 6, the width W1 of the layer part 52*a* in the second direction D2 is larger than the width W3 of the layer part 53*a* in the second direction D2. In other words, the width W3 of the layer part 53*a* in the second direction D2 is smaller than the width W1 of the layer part 52*a* in the second direction D2. The width W2 of the layer part 52*b* in the first direction D1 is larger than the width W4 of the layer part 53*b* in the first direction D1. In other words, the width W4 of the layer part 53*b* in the first direction D1 is smaller than the width W2 of the layer part 52*b* in the first direction D1. The unevenness 5Ad of the terminal electrode 5A is formed by the electrode layer 52 and the electrode layer 53 being stacked. At the electrode part 5Aa, the layer parts 52*a* and 53*a* are integrated to the extent that the boundary between the layer parts 52*a* and 53*a* cannot be visually recognized. The electrode part 5Ab is configured by the respective layer parts 52*b* and 53*b* of the electrode layers 52 and 53 being stacked. At the electrode part 5Ab, the layer parts 52*b* and 53*b* are integrated to the extent that the boundary between the layer parts 52*b* and 53*b* cannot be visually recognized.

The multilayer coil component 1B includes the coil 9 disposed in the element body 2. The coil axis Ax of the coil 9 extends along the third direction D3. The coil 9 has a substantially semicircular shape when viewed from the third direction D3. The part of the coil 9 that faces the terminal electrode 4A and the terminal electrode 5A is curved. When viewed from the third direction D3, the outer edge 9*a* of the coil 9 is separated from the terminal electrode 4A and the terminal electrode 5A.

Specifically, when viewed from the third direction D3, the first distance L1 that is the shortest distance between the outer edge 9*a* of the coil 9 and a corner portion 4Ac formed by the electrode part 4Aa and the electrode part 4Ab of the terminal electrode 4A is larger than the second distance L2 that is the shortest distance between the outer edge 9*a* of the coil 9 and the electrode part 4Aa and the third distance L3 that is the shortest distance between the outer edge 9*a* of the coil 9 and the electrode part 4Ab. The first region A1 is formed between the terminal electrode 4A and the coil 9. Likewise, when viewed from the third direction D3, the first distance L1 that is the shortest distance between the outer edge 9*a* of the coil 9 and a corner portion 5Ac formed by the electrode part 5Aa and the electrode part 5Ab of the terminal electrode 5A is larger than the second distance L2 that is the shortest distance between the electrode part 5Aa and the outer edge 9*a* of the coil 9 and the third distance L3 that is the shortest distance between the electrode part 5Ab and the outer edge 9*a* of the coil 9. The second region A2 is formed between the terminal electrode 5A and the coil 9.

As illustrated in FIG. 7, the first coil conductor 20 is positioned in the same layer as one electrode layer 50 and one electrode layer 52. The first coil conductor 20 is connected to the electrode layer 52 via the connecting conductor 20*a*. The connecting conductor 20*a* is connected to the layer part 52*a*. The connecting conductor 20*a* connects the first coil conductor 20 and the electrode layer 52. The connecting conductor 20*a* may be connected to the layer part 52*b*. The first coil conductor 20 is separated from the electrode layer 50 positioned in the same layer. In the present embodiment, the first coil conductor 20, the connecting conductor 20*a*, the connection portion 20*b*, and the electrode layer 52 are integrally formed.

The first connection conductor 26 is disposed in the dielectric layer 6 between the first coil conductor 20 and the second coil conductor 21. One electrode layer 51 and one electrode layer 53 are positioned in the dielectric layer 6 where the first connection conductor 26 is disposed. The first connection conductor 26 is separated from the electrode layers 51 and 53 positioned in the same layer. As illustrated in FIG. 6, the first connection conductor 26 is disposed in the second region A2.

As illustrated in FIG. 7, the second coil conductor 21 is positioned in the same layer as one electrode layer 50 and one electrode layer 51. The second coil conductor 21 is separated from the electrode layers 50 and 51 positioned in the same layer.

The second connection conductor 27 is disposed in the dielectric layer 6 between the second coil conductor 21 and the third coil conductor 22. One electrode layer 51 and one electrode layer 53 are positioned in the dielectric layer 6 where the second connection conductor 27 is disposed. The second connection conductor 27 is separated from the electrode layers 51 and 53 positioned in the same layer. As illustrated in FIG. 6, the second connection conductor 27 is disposed in the first region A1.

As illustrated in FIG. 7, the third coil conductor 22 is positioned in the same layer as one electrode layer 50 and one electrode layer 52. The third coil conductor 22 is separated from the electrode layers 50 and 52 positioned in the same layer.

The third connection conductor 28 is disposed in the dielectric layer 6 between the third coil conductor 22 and the fourth coil conductor 23. One electrode layer 51 and one electrode layer 53 are positioned in the dielectric layer 6 where the third connection conductor 28 is disposed. The third connection conductor 28 is separated from the electrode layers 51 and 53 positioned in the same layer.

The fourth coil conductor 23 is positioned in the same layer as one electrode layer 50 and one electrode layer 52. The fourth coil conductor 23 is separated from the electrode layers 50 and 52 positioned in the same layer.

The fourth connection conductor 29 is disposed in the dielectric layer 6 between the fourth coil conductor 23 and the fifth coil conductor 24. One electrode layer 51 and one electrode layer 53 are positioned in the dielectric layer 6 where the fourth connection conductor 29 is disposed. The fourth connection conductor 29 is separated from the electrode layers 51 and 53 positioned in the same layer.

The fifth coil conductor 24 is positioned in the same layer as one electrode layer 50 and one electrode layer 52. The fifth coil conductor 24 is separated from the electrode layers 50 and 52 positioned in the same layer.

The fifth connection conductor 30 is disposed in the dielectric layer 6 between the fifth coil conductor 24 and the sixth coil conductor 25. One electrode layer 51 and one electrode layer 53 are positioned in the dielectric layer 6 where the fifth connection conductor 30 is disposed. The fifth connection conductor 30 is separated from the electrode layers 51 and 53 positioned in the same layer. As illustrated in FIG. 6, the fifth connection conductor 30 is disposed in the second region A2.

As illustrated in FIG. 7, the sixth coil conductor 25 is positioned in the same layer as one electrode layer 50 and one electrode layer 52. The sixth coil conductor 25 is connected to the electrode layer 50 via the connecting conductor 25*a*. The connecting conductor 25*a* is connected to the layer part 50*a*. The connecting conductor 25*a* connects the sixth coil conductor 25 and the electrode layer 50. The connecting conductor 25*a* may be connected to the layer part 50*b*. The sixth coil conductor 25 is separated from the electrode layer 52 positioned in the same layer. In the present embodiment, the sixth coil conductor 25, the connecting conductor 25*a*, the connection portion 25*b*, and the electrode layer 50 are integrally formed.

In the multilayer coil component 1B according to the present embodiment, it is possible to suppress a decline in reliability while realizing size reduction as described above and as in the multilayer coil component 1.

In the multilayer coil component 1B according to the present embodiment, the terminal electrodes 4A and 5A are formed by the electrode layers 50 and 52 and the electrode layers 51 and 53 being stacked in the third direction D3. When viewed from the third direction D3, the width W3 of the electrode layers 51 and 53 in the second direction D2 and the width W4 of the electrode layers 51 and 53 in the first direction D1 are smaller than the width W1 of the electrode layers 50 and 52 in the second direction D2 and the width W2 of the electrode layers 50 and 52 in the first direction D1. The first connection conductor 26, the second connection conductor 27, and the fifth connection conductor 30 disposed in the first region A1 or the second region A2 are disposed in the same layer as the electrode layers 51 and 53. In this configuration, it is possible to increase the distance between the terminal electrodes 4A and 5A and the first connection conductor 26, the second connection conductor 27, and the fifth connection conductor 30 disposed in the first region A1 or the second region A2. Accordingly, in the multilayer coil component 1B, the stray capacitance generated between the terminal electrodes 4A and 5A and the coil 9 can be reduced. As a result, it is possible to achieve an improvement in characteristics in the multilayer coil component 1B.

Although embodiments of the present invention have been described above, the present invention is not necessarily limited to the above-described embodiments and various modifications can be made without departing from the scope of the present invention.

A form in which the coil 9 has the first coil conductor 20, the second coil conductor 21, the third coil conductor 22, the fourth coil conductor 23, the fifth coil conductor 24, the sixth coil conductor 25, the first connection conductor 26, the second connection conductor 27, the third connection conductor 28, the fourth connection conductor 29, and the fifth connection conductor 30 has been described as an example in the above embodiment. However, the numbers of the plurality of coil conductors and the plurality of connection conductors constituting the coil 9 are not limited to the values described above. The same applies to the coil 9A.

A form in which the second connection conductor 27 is disposed in the first region A1 and the first connection conductor 26 and the fifth connection conductor 30 are disposed in the second region A2 in the multilayer coil component 1 has been described as an example in the above embodiment. However, at least two of the plurality of connection conductors may be disposed in the first region A1 or the second region A2. The same applies to the multilayer coil components 1A and 1B.

A form in which the coil 9 has a substantially semicircular shape when viewed from the third direction D3 has been described as an example in the above embodiment. However, the shape of the coil 9 is not limited thereto. For example, the coil 9 may have a triangular shape. The part of the coil 9 that overlaps the terminal electrodes 4 and 5 when viewed from the second direction D2 may have a shape in which the outer shape of the outer edge 9*a* in the second direction D2 becomes small from the main surface 2*c* toward the main surface 2*d* when viewed from the third direction D3.

A form in which the terminal electrode 4, 4A has the electrode part 4*a*, 4Aa and the electrode part 4*b*, 4Ab, the terminal electrode 5, 5A has the electrode part 5*a*, 5Aa and the electrode part 5*b*, 5Ab, and each of the terminal electrode 4, 4A and the terminal electrode 5, 5A has an L shape when viewed from the third direction D3 has been described as an example in the above embodiment. The electrode part 4*a*, 4Aa and the electrode part 5*a*, 5Aa as a whole may extend along the first direction D1 when viewed from the third direction D3. In addition, the electrode part 4*b*, 4Ab and the electrode part 5*b*, 5Ab as a whole may extend along the second direction D2 when viewed from the third direction D3. Accordingly, unevenness may be provided on the surfaces of the electrode part 4*a*, 4Aa, the electrode part 4*b*, 4Ab, the electrode part 5*a*, 5Aa, and the electrode part 5*b*, 5Ab that come into contact with (face) the element body 2.

A form in which the corner portion 4*c* of the terminal electrode 4 is defined by the electrode part 4*a* and the electrode part 4*b* that form a substantially right angle has been described as an example in the above embodiment. However, the corner portion 4*c* may be defined by a surface that curves from the electrode part 4*a* toward the electrode part 4*b* or may be defined by a surface that is linearly inclined from the electrode part 4*a* toward the electrode part 4*b*.

What is claimed is:

1. A multilayer coil component comprising:

an element body having a plurality of stacked dielectric layers and having a pair of end surfaces facing each other, a pair of main surfaces facing each other, and a pair of side surfaces facing each other in a stacking direction of the plurality of dielectric layers, one of the pair of main surfaces configured to be a mounting surface;

a coil (i) in the element body, (ii) including (a) a plurality of coil conductors, each of the plurality of coil conductors having a connection portion at one end, and (b) a plurality of connection conductors connecting the connection portions adjacent to each other in the stacking direction, and (iii) having a coil axis extending along the stacking direction; and a pair of terminal electrodes (i) connected to the coil and (ii) in recess portions of the element body on the pair of end surfaces of the element body, wherein each of the recess portions of the element body is over one of the pair of the end surfaces and the one of the pair of main surfaces configured to be the mounting surface, each of the pair of terminal electrodes has a first part extending along a facing direction of the pair of main surfaces and a second part extending along a facing direction of the pair of end surfaces when viewed from the stacking direction, the plurality of connection conductors do not overlap the plurality of coil conductors except for the connection portions when viewed from the stacking direction, at least two of the plurality of connection conductors are in a region between one of the pair of the terminal electrodes and an outer edge of the coil when viewed from the stacking direction, and the region overlaps the first part when viewed from the facing direction of the pair of end surfaces and overlaps the second part when viewed from the facing direction of the pair of main surfaces.

2. The multilayer coil component according to claim 1, wherein each of the pair of the terminal electrodes is formed by a first electrode layer and a second electrode layer stacked in the stacking direction, a width of the first electrode layer in the facing direction of the pair of end surfaces and a width of the first electrode layer in the facing direction of the pair of main surfaces are smaller than a width of the second electrode layer in the facing direction of the pair of end surfaces and a width of the second electrode layer in the facing direction of the pair of main surfaces when viewed from the stacking direction, and the connection conductor in the region is in the same layer as the first electrode layer.

3. The multilayer coil component according to claim 1, wherein the connection conductor in the region has a part parallel to the outer edge of the coil when viewed from the stacking direction.

4. The multilayer coil component according to claim 1, wherein a part of the coil overlapping the one of the pair of the terminal electrodes when viewed from the facing direction of the pair of end surfaces has a shape in which an outer shape of the outer edge in the facing direction of the pair of end surfaces becomes small from a main surface of the pair of main surfaces that is not configured to be the mounting surface toward the one of the pair of mounting surfaces configured to be the mounting surface when viewed from the stacking direction.

5. The multilayer coil component according to claim 1, wherein a first distance as a shortest distance between an outer edge of the coil and a corner portion formed by the first part and the second part is larger than a second distance as a shortest distance between the first part and an outer edge of the coil and a third distance as a shortest distance between the second part and the outer edge of the coil when viewed from the stacking direction.

6. The multilayer coil component according to claim 5, wherein the connection conductor in the region is on a straight line connecting the corner portion of the one of the terminal electrodes and the outer edge of the coil and having the first distance when viewed from the stacking direction.

* * * * *